US009453713B1

(12) United States Patent
Langner

(10) Patent No.: US 9,453,713 B1
(45) Date of Patent: Sep. 27, 2016

(54) SYSTEMS AND METHODS FOR AMMUNITION FOR A DISRUPTER CANNON

(71) Applicant: F. Richard Langner, Fountain Hills, AZ (US)

(72) Inventor: F. Richard Langner, Fountain Hills, AZ (US)

( * ) Notice: Subject to any disclaimer, the term of this patent is extended or adjusted under 35 U.S.C. 154(b) by 321 days.

(21) Appl. No.: 13/797,137

(22) Filed: Mar. 12, 2013

Related U.S. Application Data

(63) Continuation of application No. 13/617,089, filed on Sep. 14, 2012, now abandoned.

(60) Provisional application No. 61/659,414, filed on Jun. 13, 2012, provisional application No. 61/628,006, filed on Oct. 24, 2011, provisional application No. 61/628,115, filed on Oct. 25, 2011.

(51) Int. Cl.

| | |
|---|---|
| ***F42B 5/02*** | (2006.01) |
| ***F42B 33/00*** | (2006.01) |
| ***F42B 7/10*** | (2006.01) |
| ***F42B 12/02*** | (2006.01) |
| ***F42D 5/04*** | (2006.01) |

(52) U.S. Cl.
CPC . *F42B 5/02* (2013.01); *F42B 7/10* (2013.01); *F42B 12/02* (2013.01); *F42B 33/001* (2013.01); *F42D 5/04* (2013.01)

(58) Field of Classification Search
CPC ..... F42D 5/04; F42B 5/00; F42B 5/02; F42B 7/10; F42B 33/06; F42B 7/00; F42B 7/02; F42B 12/02; F42B 33/00; F42B 33/001
USPC ..... 102/430, 438, 439; 86/50, 43
See application file for complete search history.

(56) References Cited

U.S. PATENT DOCUMENTS

| | | | | |
|---|---|---|---|---|
| 448,057 | A * | 3/1891 | Long | 102/439 |
| 3,485,170 | A * | 12/1969 | Scanlon | 102/432 |
| 3,695,141 | A * | 10/1972 | Kronman | F41F 1/00 102/501 |
| 4,062,112 | A * | 12/1977 | Lake | 30/228 |
| 4,779,511 | A * | 10/1988 | Proctor | F42B 33/06 86/50 |
| 4,928,574 | A | 5/1990 | Golden | |
| 5,148,750 | A | 9/1992 | Becker | |
| 5,210,368 | A * | 5/1993 | Heller et al. | 86/50 |
| 5,259,319 | A * | 11/1993 | Dravecky et al. | 102/447 |
| 5,454,323 | A | 10/1995 | Conil | |
| 5,844,163 | A | 12/1998 | Lindskog | |
| 6,490,957 | B1 * | 12/2002 | Alexander | F41B 11/00 102/230 |
| 7,066,093 | B2 | 6/2006 | Ronn | |
| 7,555,977 | B2 | 7/2009 | Crotty | |

(Continued)

FOREIGN PATENT DOCUMENTS

| | | |
|---|---|---|
| EP | 0051119 | 5/1982 |
| EP | 0120215 | 10/1984 |

(Continued)

*Primary Examiner* — James S Bergin
(74) *Attorney, Agent, or Firm* — Letham Law Firm LLC; Lawrence Letham

(57) ABSTRACT

Systems and methods for preparing a cartridge and a projectile for use in a disrupter to launch the projectile toward an explosive device to disable the explosive device. The cartridge may be selected from a group of cartridges and the projectile may be selected from a group of projectiles in accordance with the type of explosive device, the projectile selected, or other considerations for attempting to disable the explosive device. The cartridge and projectile are manually coupled by an operator of the disrupter for use in the disrupter.

19 Claims, 7 Drawing Sheets

(56) References Cited

U.S. PATENT DOCUMENTS

| | | | | |
|---|---|---|---|---|
| 7,712,417 | B1 | 5/2010 | Einstein | |
| 7,905,182 | B2 | 3/2011 | Janik | |
| 7,947,937 | B1 * | 5/2011 | Langner | 244/3.16 |
| 8,245,430 | B1 * | 8/2012 | Owenby et al. | 42/84 |
| 8,276,495 | B1 * | 10/2012 | Chiu et al. | 86/50 |
| 8,915,004 | B1 * | 12/2014 | Langner | 42/69.01 |
| 9,200,881 | B1 * | 12/2015 | Langner | F42B 33/06 |
| 9,322,625 | B1 * | 4/2016 | Langner | F41B 9/0046 |
| 2011/0214583 | A1 | 9/2011 | Dutch | |
| 2012/0174813 | A1 | 7/2012 | Battaglia | |

FOREIGN PATENT DOCUMENTS

| | | |
|---|---|---|
| EP | 0424057 | 4/1991 |
| EP | 0784778 | 7/1997 |
| EP | 1055096 | 11/2000 |
| GB | 470250 | 8/1937 |

* cited by examiner

SYSTEMS AND METHODS FOR AMMUNITION FOR A DISRUPTER CANNON

CROSS-REFERENCE TO RELATED APPLICATIONS

This application is a continuation of and claims priority under 35 U.S.C. §120 to U.S. patent application Ser. No. 13/617,089 filed Sep. 14, 2012, which claims priority under 35 U.S.C. §119(e) from U.S. provisional patent application No. 61/659,414 filed Jun. 13, 2012; 61/628,006 filed Oct. 24, 2011; and 61/628,115 filed Oct. 25, 2011; each of which is hereby incorporated by reference.

FIELD OF THE INVENTION

Embodiments of the present invention relate to disrupter cannons used to disable explosive devices.

BACKGROUND OF THE INVENTION

Disrupter cannons are used by military, bomb squad, and other emergency service personnel to destroy and/or disable explosive devices including improvised explosive devices ("IED"), bombs, and ordinance.

Disrupter cannons propel a projectile to impact the explosive device. Impact of the projectile with the explosive device may interfere with (e.g., damage, destroy) a portion of the explosive device to disable the explosive device. Impact of the projectile with the explosive device may trigger (e.g., start, initiate, cause) explosion of the explosive device thereby destroying the device.

Disrupter cannons may benefit from improvements, according to the various aspects of the present invention, that increase a force of delivery of a liquid projectile, decrease an amount of powder residue that enters a firing assembly, and improve the reliability of the operation of the firing assembly.

BRIEF DESCRIPTION OF THE DRAWING

Embodiments of the present invention will now be further described with reference to the drawing, wherein like designations denote like elements, and.

DETAILED DESCRIPTION OF THE PREFERRED EMBODIMENTS

Figure 1:
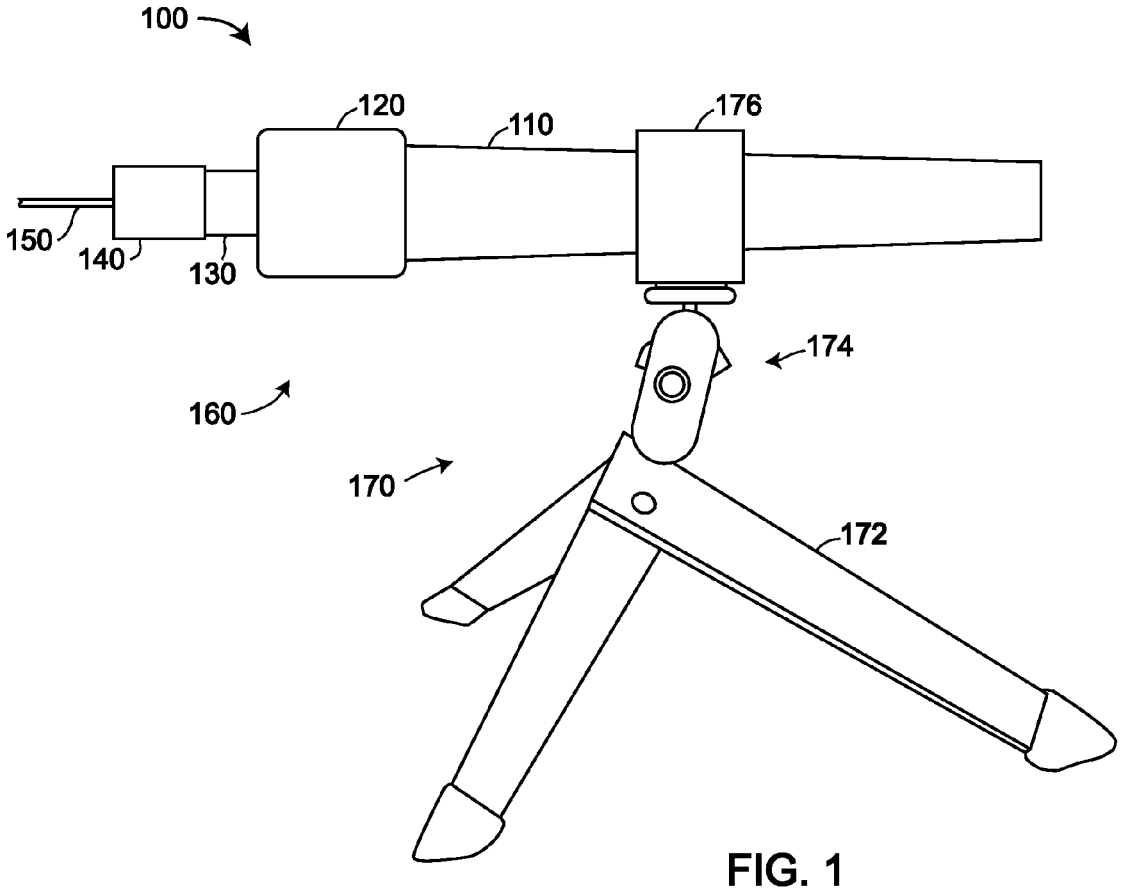
FIG. 1 is a plan view of a disrupter system.
Figure 2:
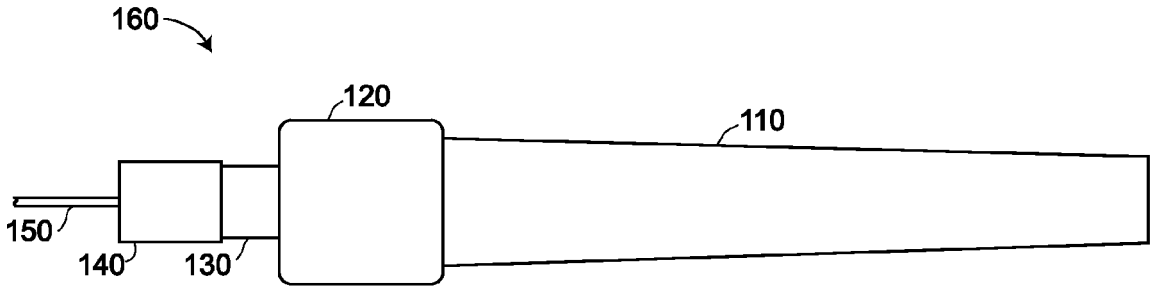
FIG. 2 is a plan view of a disrupter cannon according to various aspects of the present invention.
Figure 3:
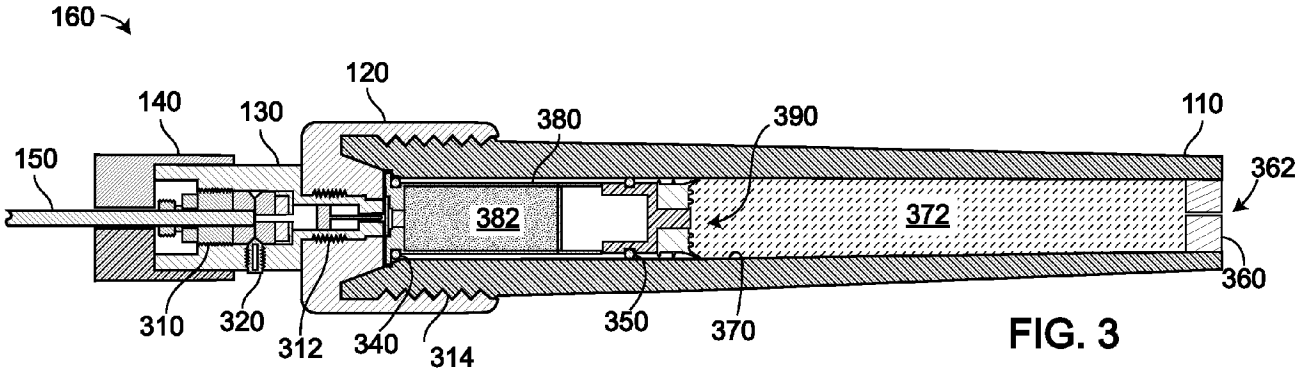
FIG. 3 is a cross-section view of the disrupter cannon of FIG. 2 along a central axis.

Disrupter system 100 may be used to disable and/or destroy explosive devices. Disrupter cannon 160 may propel a projectile for disabling and/or destroying the explosive device. Mount 170 positions and supports disrupter cannon 160 for propelling a projectile toward an explosive device.

Holder 176 holds (e.g., clamps, secures) to disrupter cannon 160 and to positioner 174. Holder 176 may retain disrupter cannon 160 prior to firing disrupter cannon 160. Holder 176 may retain disrupter cannon 160 after firing disrupter cannon 160 or holder 176 may release disrupter cannon 160 responsive to a recoil force to allow disrupter cannon 160 to separate from holder 176 and thereby from mount 170.

Positioner 174 moves to position disrupter cannon 160 so that the trajectory of the projectile launched by disrupter cannon 160 is directed toward the explosive device. Positioner 174 may orient disrupter cannon 160 so that the muzzle of barrel 110 of disrupter cannon 160 is oriented in an upward, a downward, or a horizontal direction with respect to the ground (e.g., a direction of a force of gravity). The position of positioner 174 may be locked (e.g., held) to retain the orientation (e.g., aim) of disrupter cannon 160.

Tripod 172 supports the weight of disrupter cannon 160. Tripod 172 may include any conventional tripod or support for supporting equipment (e.g., cameras, guns, cannons). Tripod 172 may be position an effective distance, with respect to the range of the projectile used, away from the explosive device. An effective distance may be in the range of 6 to 48 inches, preferably 16 to 22 inches. Tripod 172 may move responsive to a recoil force of firing disrupter cannon 176.

Disrupter cannon 160 may include cover 140, firing assembly 130, breech cap 120, and barrel 110. Disrupter cannon 160 may cooperate with shock tube 150 and cartridge 380 to launch a projectile.

A type of projectile may be selected to disable and/or destroy an explosive device. A projectile type may include a structure suitable for disabling and/or destroying a particular type of explosive device. A projectile may include one or more objects having a shape (e.g., balls, fragments, pointed structure, snub nose) for propelling toward a target. Objects of a projectile may be held together prior to launch in a container (e.g., shell).

A material (e.g., composition, type, substance) of a projectile may be selected to disable and/or destroy an explosive device. Materials may include metal, clay, plastic, and liquids. Materials of a projectile may include a combination of materials, for example, portions of the projectile formed of different metals (e.g., aluminum, titanium).

A material of a projectile may be further selected to protect personnel in the vicinity of the explosive device. For example, a projectile may be formed of a frangible material (e.g., compressed powder) that breaks apart (e.g., disperses) on impact. A projectile may include a mass (e.g., body, amount) of a liquid. A liquid may include water. A mass of a liquid may be propelled from a disrupter cannon to impact an explosive device to disable and/or destroy the explosive device. A liquid may further disperse on impact with an explosive device thereby protecting personnel in the vicinity.

For example, the barrel of a disrupter cannon may be filled with a liquid and the liquid propelled toward an explosive device. On impact, the liquid may move, disable, or destroy the explosive device depending on an amount of force applied by the liquid to the explosive device.

A liquid projectile increases the safety of dealing with explosive devices because the liquid disperses on impact and may dampen (e.g., wet) any explosive materials ejected from the explosive device thereby decreasing the likelihood of explosion close to personnel. However, presently liquid projectiles are less effective than a solid projectile, including compressed powders, because the force delivered by a liquid projectile is less than the force delivered by a solid projectile.

According to various aspects of the present invention, disrupter cannon 160 may cooperate with piston 390 to increase the effectiveness of a liquid projectile.

Another issue with conventional disrupter cannons is the amount of cleaning and maintenance required between firings. A further issue is whether the disrupter cannon may be operated without the use of tools to reload the disrupter cannon.

A disrupter cannon propels a projectile by producing a rapidly expanding gas. The rapidly expanding gas is generally produced by burning a pyrotechnic (e.g., gun powder, explosive charge). Generally, the pyrotechnic is held in a cartridge. Firing (e.g., activating, igniting) the cartridge burns the pyrotechnic. The burning pyrotechnic produces residue (e.g., byproducts, gasses, soot, ash) that may enter the firing assembly. The residue may coat (e.g., foul, dirty) the components of the firing assembly and interfere with the proper operation of the firing assembly. Reducing the residue that enters the firing assembly increases the number of firings a disrupter cannon may perform between cleanings.

According to various aspects of the present invention, cartridge 380 may cooperate with barrel 110, breech cap 120, and firing assembly 130 to decrease the amount of residue that enters firing assembly 130 when cartridge 380 is fired.

Even a small amount of residue may interfere with the proper operation of the firing pin of the firing assembly of a conventional disrupter cannon. Prior to firing (e.g., operating) a disrupter cannon, the firing pin is positioned away from the cartridge. The cartridge is activated by moving the firing pin toward the cartridge so that the firing pin strikes the primer of the cartridge to ignite the pyrotechnic. After the cartridge is activated, the firing pin returns to its original (e.g., pre-firing) position, so it may be move to activate a subsequent cartridge. If the firing pin does not return to its original position, it cannot be move to strike the primer of a subsequent cartridge with sufficient force to activate the cartridge.

Present disrupter cannons use a spring to return the firing pin to its pre-firing position. The force that moves the firing pin from the pre-firing position to the firing (e.g., activate cartridge) position is provided by shock tube 150. Shock tube 150 includes a pyrotechnic that when burned moves a gas along an inner diameter of shock tube 150. The expanding gas moves out of an end of shock tube 150 to apply a force on the firing pin to move the firing pin to activate the cartridge. Residue from the gas from shock tube 150 or from a subsequent firing of a cartridge may coat the spring.

The expanding gas produced by the burning pyrotechnic of a conventional cartridge may also enter the firing assembly and coat the spring with a residue. Further, the primer of a conventional cartridge may be destroyed during the firing process thereby permitting the conventional cartridge to blow gas, primer remains, and residue into the firing assembly. The gas from a cartridge may produce an amount of residue that is significantly greater than the residue produced by a shock tube.

Residue and other contaminants may prevent a spring from returning the firing pin to the pre-firing position. Residue and other contaminants may reduce a force provided by a spring thereby interfering with the operation of the firing assembly. Generally, proper operation of the firing assembly can be restored by disassembling and cleaning the firing assembly.

According to various aspects of the present invention, firing pin 440 may cooperate with magnet 436 to return firing pin 440 to its pre-firing position and to reduce an effect of residue on the movement of firing pin 440.

The components of disrupter cannon 160, the cooperation of the components of disrupter cannon 160 with each other, and the cooperation of the components of disrupter cannon 160 with other components and devices (e.g., cartridge 380, piston 390, shock tube 150, stopper 360, mount 170) are discussed below.

A barrel includes a muzzle end portion (e.g., exit), a breech end portion (e.g., rear), and a bore therebetween. Prior to firing, the bore of the barrel holds (e.g., contains) a projectile and a cartridge. Upon firing the cartridge, the barrel in cooperation with breech cap 120, contains, at least in part and for a period of time, the force provided by the rapidly expanding gas generated by burning the pyrotechnic of the cartridge. The barrel and breech cap direct the force provided by the rapidly expanding gas against the projectile. The force moves the projectile from the breech end portion of the barrel toward the muzzle end portion of the barrel along the bore until the projectile exits the barrel at the muzzle end portion of the barrel. A barrel directs an initial flight of a projectile. The projectile continues along the trajectory established by the barrel after the projectile exits the barrel. A material for a barrel may include a lightweight composite material and a metal.

A diameter of the bore of a barrel may be suitable to allow passage of convention projectiles (e.g., bullet, shell) or to accept any conventional cartridge. In one implementation, the barrel receives a conventional 12-guage shotgun shell in the breech end of the barrel. A surface of the bore may be smooth or rifled. A length of a barrel for a disrupter cannon may be in the range of 10 inches to 30 inches.

In an implementation, barrel 110 is formed of titanium and an external surface of barrel 110 is wrapped in carbon fiber. In another implementation, barrel 110 is formed of stainless steel.

A breech cap couples to the breech end portion of a barrel. A breech cap forms a chamber at a breech end portion of the barrel. A breech cap retains a cartridge in the breech end portion of a barrel. The breech cap positions the firing assembly for activating the cartridge. A breech cap cooperates with the barrel to contain and direct a force of the rapidly expanding gas provided by the cartridge as discussed above. In operation, the expanding gas provided by a cartridge cannot readily exit the chamber formed at the breech end portion of the barrel, so the breech cap directs the force of the expanding gas toward the muzzle end portion of the barrel and against the projectile.

A portion of the expanding gas may escape the chamber formed by the breech cap. It is possible, depending on the type of coupling used to couple the breech cap to the barrel, that a portion of the expanding gas may escape from the chamber via the coupling. Further it is possible, if the cartridge is mechanically fired (e.g., firing pin), that a portion of the expanding gas may bypass the firing pin and enter the firing assembly as discussed above.

A coupling between a breech cap and a barrel must be sufficiently strong for the breech cap to remain coupled to the barrel during firing of the cartridge and launch of the projectile. Any coupling mechanism (e.g., threads, bayonet, latch) that can withstand the force of the expanding gas provide by the cartridge is suitable for coupling the breech cap to the barrel. A breech cap may be moveable coupled (e.g., hinged, threaded) to a barrel. A breech cap may be completely removable (e.g., disconnected, decoupled) from a barrel.

The coupling between a breech cap and a barrel must be able to be decoupled after firing the cartridge to permit a new cartridge and projectile to be inserted into the barrel for a subsequent launching of the projectile. Preferably, decoupling should be able to be accomplished manually without the use of tools. A coupling that becomes difficult to decouple after the cartridge is fired and the projectile launched reduces the frequency of operation of the disrupter cannon because extra time must be used to remove the breech cap and reload the disrupter cannon.

In an implementation, breech cap 120 threadedly couples to barrel 110 using threads 314. In an implementation, threads 314 are coarse ACME threads. Breech cap 120 is manually threaded to barrel 110 to couple breech cap 120 to barrel 110. Preferably, breech cap 120 can be manually unthreaded to decouple breech cap 120 from barrel 110. The thread type may contribute to the effect the expanding gas has on the coupling between the breech cap 120 and barrel 110. Preferably, the thread type increases the likelihood of being able to manually remove, without the use of tools, breech cap 120 from barrel 110 after firing; however, other factors play a role, such as the pyrotechnic used in the cartridge, whether the casing of the cartridge is bent out of shape by firing, and the amount of gas that escapes from the cartridge into the breech end portion of the disrupter cannon.

A firing assembly activates the cartridge to launch the projectile. A firing assembly activates the cartridge responsive to an action taken by an operator of the disrupter cannon. A firing assembly may operate as a transducer in that it transforms one form of energy into another form of energy to activate the cartridge.

For example, a firing assembly for an electrically fired cartridge may translate the movement of an operator's digit into an electrical signal that activates the cartridge. A firing assembly for a mechanically fired cartridge may translate an electrical signal or mechanical movement into movement (e.g., displacement) of a firing pin that strikes the cartridge to activate the cartridge. A firing assembly may translate a force provided by an expanding gas into movement of the firing pin to strike the cartridge.

Prior to firing a disrupter cannon, the firing pin of a mechanical firing assembly is positioned away from the cartridge. To fire the cartridge, the firing pin moves toward the cartridge to strike the primer of the cartridge to fire the cartridge. Preferably, after firing the cartridge, the firing pin returns to the pre-firing position to be ready to fire a subsequent cartridge. Preferably, the firing pin returns to the pre-firing position without manual intervention by a human. Generally, a force is applied to move the firing pin from the forward (e.g., firing) position back to the pre-firing position. As discussed above, such force is conventionally provided by a spring.

Figure 11:
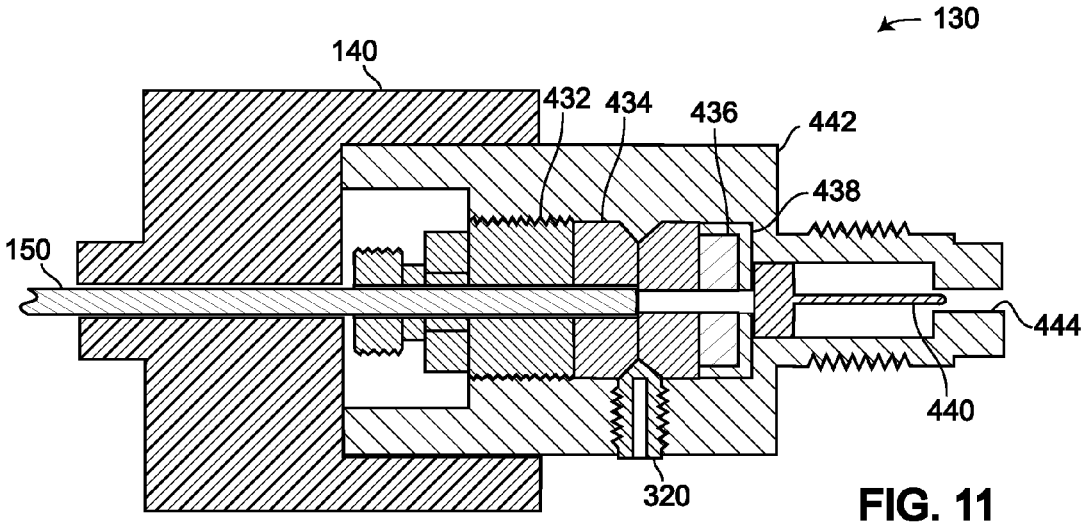
FIG. 11 is a close-up view of the firing mechanism of FIG. 3 before or after firing the disrupter cannon.
Figure 12:
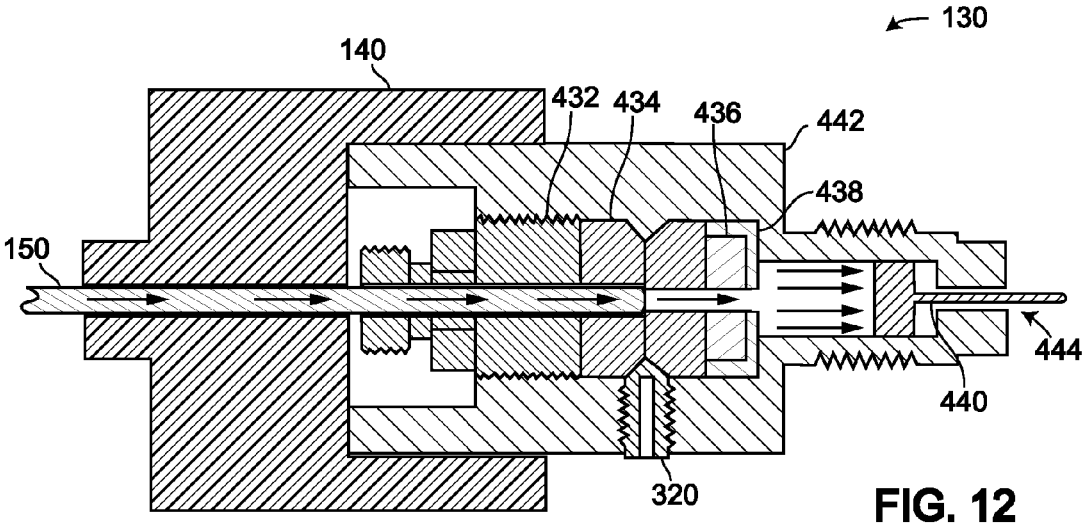
FIG. 12 is a close-up view of the firing mechanism of FIG. 3 during firing the disrupter cannon.
Figure 13:
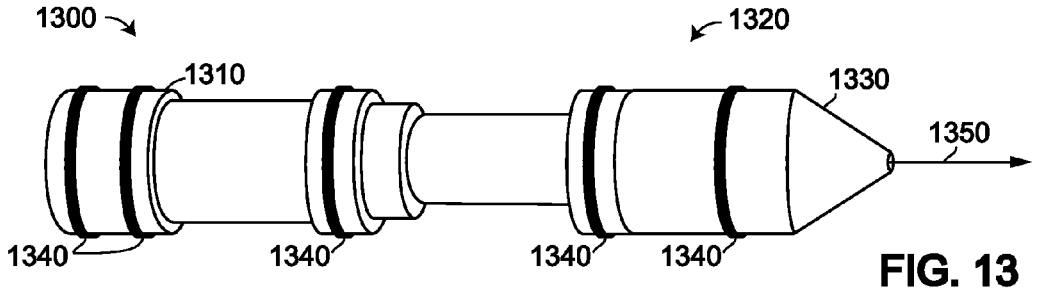
FIGS. 13-17 are plan views of projectiles for launching by the disrupter cannon of FIG. 2.
Figure 14:
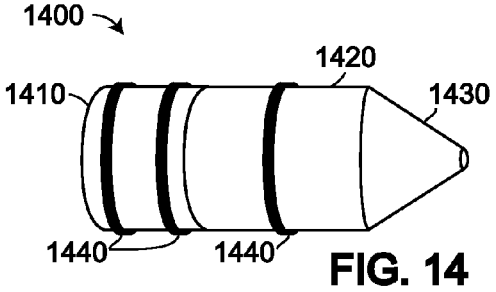
Figure 15:
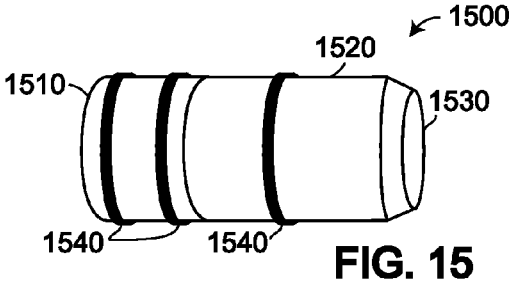
Figure 16:
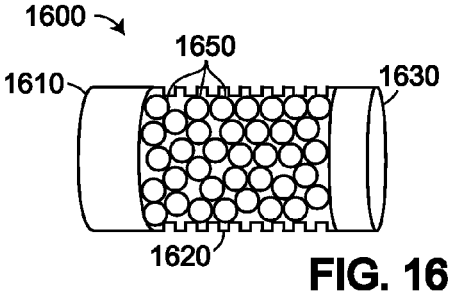
Figure 17:
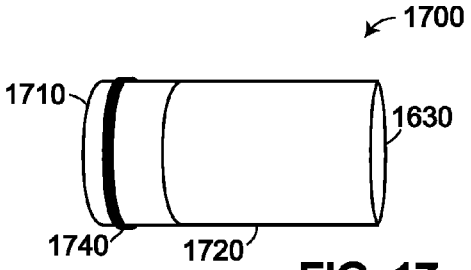

In an implementation, shock tube 150 provides a force of an expanding gas to move firing pin 440 from the pre-firing position, as shown in FIG. 11, to the firing position, as shown in FIG. 12. The expanding gas provided by shock tube 150, as discussed above, is provided by burning a pyrotechnic in the interior bore of the shock tube. The gas provided by the burning pyrotechnic of shock tube 150 moves along a length of shock tube 150 and exits the ends of shock tube 150. One end of shock tube 150 is positioned in the chamber that retains firing pin 440. The gas that exits shock tube 150 applies a force on firing pin 440 that moves firing pin 440 from a pre-firing position to a firing position.

In a pre-firing position, firing pin 440 may be proximate to magnet 436 and even contact cover 438. In a firing position, firing pin 440 is positioned distal from magnet 436. In the firing position, firing pin 440 may be positioned toward a forward wall of the firing pin chamber and even contact a forward portion of housing 442. Firing pin 440 in FIG. 12 is positioned a distance away from contacting a forward portion of housing 442. Movement of firing pin 440 further to the right in FIG. 12 would position firing pin 440 in contact with a forward portion of housing 442.

As discussed above, the gas from shock tube 150 may include residue that coats firing pin 440 or the surfaces of the chamber that contains firing pin 440. The residue from shock tube 150 may interfere the return of firing pin 440 to the pre-firing position and thereby interfere with subsequent operations of disrupter cannon 160 unless firing assembly 130 is cleaned.

Operation of disrupter cannon 160 may be improved by reducing the amount of residue that enters firing assembly 130, whether carried by the gas from cartridge 160 or the gas from shock tube 150, and/or by eliminating mechanisms from the firing assembly that may be affected by residue.

According to various aspects of the present invention, disrupter system 100 of FIGS. 1-12 may reduce an amount of residue that enters a firing assembly, eliminate mechanisms from the firing assembly that are more affected by residue, and deliver a liquid projectile with an increased amount of force.

According to various aspects of the present invention, cartridge 380 cooperates with barrel 110 and breech cap 120 to reduce the amount of expanding gas produced by cartridge 380 that enters firing assembly 130 via bore 444.

To operate disrupter cannon 160, a projectile is positioned in bore 370 of barrel 110 forward, with respect to the muzzle of barrel 110, of cartridge 380, which is also positioned in bore 370 of barrel 110. Beech cap 120 is coupled to the breech end portion of barrel 110. Firing assembly 130 is coupled to breech cap 120.

In an implementation, firing assembly 130 is threadedly coupled to breech cap 120 using threads 312. Firing assembly 130 couples to breech cap 130 to position firing pin 440 along a central axis of barrel 110 and cartridge 380.

Cartridge 380 includes casing 820, plate 484, seal 340, primer 810, pyrotechnic 382, and cover 486. Casing 820 includes rear portion 480 and surface 482. Cartridge 380 performs the functions of a cartridge discussed above.

A casing provides the structure of a cartridge. A casing establishes a size of the cartridge. A casing establishes a shape of the cartridge. A casing includes a cavity for retaining a pyrotechnic, a bore for receiving primer 810, a cavity (e.g., depression, hollow, lowered surface, recess, indentation) for receiving plate 484, a cavity for optionally receiving a projectile, a surface for sealing with seal 340, and structure for coupling cover 486. A casing positions a primer 810 to cooperate with firing pin 440 to fire cartridge 380. Rear portion 480 provides structure (e.g., larger diameter, surface) for interfering with a breech end portion of barrel 110 to position cartridge 380 with respect to the breech end portion of barrel 110. Rear portion 480 further provides surface 482 for contacting (e.g., sealing with) the breech end portion of barrel 110.

As discussed above, a pyrotechnic produces a rapidly expanding gas. A pyrotechnic may experience a chemical reaction (e.g., burning) to produce the rapidly expanding gas. The rapidly expanding gas may provide a force. A force may launch a projectile. A magnitude of a force provided by a rapidly expanding gas may vary over time. Variance of the magnitude of the force over time may be referred to as a profile of the force (e.g., force profile). The force profile may start with ignition of the pyrotechnic and end when the pyrotechnic is exhausted.

A chemical composition of a pyrotechnic may be selected and/or formulated to produce a particular force profile. A fast burn force profile may include a rapid peak in the magnitude of the force followed by a rapid decrease in the magnitude of the force provided followed by a decreased magnitude of force until the pyrotechnic is exhausted. A slow burn force profile may include delivery of a near constant magnitude of force from shortly after ignition of the pyrotechnic until the chemical reaction of the pyrotechnic is exhausted.

The high magnitude of the force of a force profile may differ according to the amount (e.g., load) of pyrotechnic burned. A low load amount of pyrotechnic may provide a maximum magnitude of force while a high load produces a greater maximum magnitude. A particular load may deliver its maximum magnitude of force with a fast burn or a slow burn force profile depending on the type, not the amount, of pyrotechnic in the cartridge.

The force profile of the pyrotechnic used to fire disrupter cannon 160 may be a factor in whether breech cap 120 may be removed from barrel 110 without tools after firing. The force profile is also a factor as to whether the structural integrity of the casing of the cartridge is affected by firing the cartridge. Compromising the structural integrity of the casing of the cartridge may cause the casing to get jammed (e.g., stuck) in the barrel thereby requiring tools to remove the fired cartridge before another projectile may be fired.

Testing has shown that a slow burn force profile used with aspects of the invention disclosed herein improves the likelihood that breech cap 120 can be removed from barrel 110 without the use of tools after disrupter cannon 160 is fired. Further, a slow burn profile increases the likelihood that an expended aluminum casing will fall out of the breech end of barrel 110 rather than requiring a rod inserted into the muzzle end of barrel 110 to force the expended cartridge from barrel 110. A pyrotechnic with a slow burn profile, regardless of load (e.g., 60, 120, 140, 160 grains) increases the likelihood of preparing disrupter cannon 160 for a next operation without the use of tools. A pyrotechnic with a fast burn profile, especially when a large load is used, significantly increases the likelihood that tools will be required to remove breech cap 120 from barrel 110 and expended cartridge 380 from barrel 110.

A steel tube (not shown) may be inserted into casing 820 when a pyrotechnic with a fast burn profile is used to reduce the likelihood that expended casing 820 will be jammed in barrel 110 and require tools for removal.

A primer ignites a pyrotechnic to produce a rapidly expanding gas. A primer translates a physical force (e.g., being struck) into a chemical reaction (e.g., burning) that ignites the pyrotechnic. A physical force activates (e.g., ignites) the primer. A primer is generally positioned along a central axis that is along a length of the cartridge. A primer is positioned in line with a firing pin. A primer remains coupled to a casing at least prior to launch. A force of the expanding gas produced by the pyrotechnic may decouple a primer from a casing. The force from the expanding gas may move the primer away from the rear portion of the casing toward the firing pin. When the primer decouples from the casing, whether partially or completely, the expanding gas may escape from the cavity in the casing by bypassing the primer or exiting via the hole where the primer was located. The expanding gas may carry fragments of the primer into the firing assembly.

A plate couples to a casing. The coupling between the plate and the casing may include soldering, welding, friction fit, and/or gluing. A plate covers a primer. A plate deforms responsive to being struck by a firing pin. A deformation in a plate contacts a primer to activate (e.g., strike) a primer. A plate remains coupled to a casing during firing of a primer and subsequent burning of the pyrotechnic of the cartridge. A plate impedes rearward movement of the primer, under a force of the expanding gas, towards the firing assembly. A plate reduces an amount of gas that may exit the cavity in the casing via the primer. A plate reduces the amount of residue and/or primer fragments carried into a firing assembly. A plate restrains movement of the primer before, during, and after firing the cartridge.

A plate may be positioned in a cavity in rear portion of a casing of a cartridge. A cavity may position a rear external surface of the plate flush (e.g., same level, forming an unbroken plane) with the surface of the rear portion of a cartridge such that the rear surface of the cartridge is flat (e.g., continuous plane). A depth of the cavity may be about the same as the height of the plate, so that positioning the plate in the cavity forms a surface on the rear portion of the cartridge that is a continuous plane.

A breech cap, when coupled to a barrel, may press against the surface of the rear portion of the casing and the plate. A force provided by the breech cap on the plate may help (e.g., assist) a plate retain the primer in the casing. The force provided by the breech cap on the plate may help retain the plate coupled to the casing and to reduce an amount of expanding gas that escapes via the rear portion of the cartridge.

Trainers in the use of conventional disrupter cannons instruct the users to thread the breech cap on to the barrel completely then to unscrew the breech cap ¼ turn to increase the likelihood of being able to remove the breech cap with tools after firing. Conventional breech caps and conventional cartridges do not cooperate to reduce the amount of gas and residue that exits the cartridge into the firing assembly.

Rear portion 480 of casing 820 positions the cartridge in the barrel of the disrupter cannon. Rear portion 480 interferes with a breech portion of the barrel to position the cartridge. Rear portion 480 prevents cartridge 380 from entirely entering and being inside bore 370 of barrel 110.

Surface 482 on a forward part of rear portion 480 contacts a surface of the breech portion of barrel 110 to position cartridge 380 in barrel 110. Contact between surface 482 and the breech portion of barrel 110 may form a seal that reduces the amount of the rapidly expanding gas from the pyrotechnic that exits bore 370 into the chamber formed by barrel 110 and breech cap 120. A seal between surface 482 and a surface of the breech portion of barrel 110 may reduce an amount of gas from the pyrotechnic that enters firing assembly 130. Surface 482 may be formed of the same material that forms rear portion 480 of casing 820. Surface 482 may be integral with rear portion 480. Surface 482 may include a coating of a material (e.g., neoprene, rubber, teflon) that enhances the sealing capacity of surface 482.

A seal forms a seal (e.g., barrier). A seal that may impede movement of a gas. A seal may impede movement of a liquid. A seal may retain a gas and/or a liquid on one side of a seal and not permit passage of the gas and/or the liquid to the other side of the seal. A seal may impede movement of a residue carried by a gas and/or a liquid. A seal may form a seal with a surface. A seal may form a seal with two or more surfaces and/or between two or more surfaces. A seal may fill, at least partially, a void to form a seal. A seal may have a shape that conforms to one or more surfaces. A seal may be formed of a material that is different from the materials that form the surfaces. A seal may be pliable. A seal may be deformed to confirm to a shape of a surface. Materials for a seal include neoprene, rubber, and Teflon. A seal may form a seal with an outer surface of a casing. A seal may further form a seal with a surface of the bore of a barrel.

A cover closes an opening. A cover may seal an opening. A cover may enclose a cavity. A cover may mechanically couple to an object to close and/or seal an opening and/or enclose a cavity. Mechanically coupling may include gluing. A cover may retain a material inside a cavity. A cover may keep a material inside a cavity dry. A cover may protect a material inside a cavity during transport and handling. A cover may be removed by a force. A cover may be removed by a force provided by an expanding gas. A cover may be at least partially destroyed (e.g., torn, ripped, shredded, burned) by a force that removes the cover. A cover may be rigid. A cover may be flexible. A cover may have a uniform thickness. A cover may be formed of pieces of material, whether the same or different, that are coupled together to form the cover.

A cover may include a conventional gas seal use in conventional 10-20 gauge cartridges for conventional shotguns.

In an implementation, casing 820 of cartridge is cylindrical. Casing 820 may be similar to a conventional casing for a 12-guage shotgun cartridge. The outer diameter of the casing may be less toward a front portion as opposed to rear portion 480 (e.g., rim). Casing 820 includes a cavity for receiving pyrotechnic 382. Casing 820 includes an axial bore in rear portion 480 for receiving primer 810. In an implementation, casing 820 is formed of aluminum. In another implementation, casing 820 is formed of materials and in a manner that is comparable to the materials and manner of a conventional shotgun cartridge (e.g., shell).

Primer 810 position in the bore of rear portion 480 and mechanically coupled to casing 820. Plate 484 is positioned in cavity of rear portion 480. Plate 484 mechanically couples to casing 820. Plate 484 covers primer 810. The outer surface of plate 484 is flush with the surface of rear portion 480, so that the rear surface of cartridge 380 is nearly flat.

In another embodiment, rear portion 480 does not include a cavity for receiving plate 484, but plate 484 is the same size and shape as the surface of rear portion 480. In this embodiment, plate 484 entirely covers the surface of rear portion 480. Because plate 484 is nearly flat, the rear portion of cartridge 380 when covered by plate 484 is also nearly flat.

As discussed above, the flat surface of rear portion 480 of cartridge 380 cooperates with a surface of breech cap 120 and a forward portion of firing assembly 130 to retain plate 484 coupled to casing 810 and to reduce an amount of gas that escapes from a rear portion of cartridge 380 into firing assembly 130.

The mechanical coupling between plate 484 and casing 810, combined with the support provided by breech cap 120 and firing assembly 130 discussed above, is of sufficient strength so that a force of an expanding gas produced by primer 810 is not sufficient to decouple plate 484 from casing 820. The mechanical coupling between plate 484 and casing 810 is of sufficient strength that a force of an expanding gas produced by pyrotechnic 382 that bypasses primer 810 or that passes through the bore into which primer 810 is, or was, positioned is not sufficient to decouple plate 484 from casing 820. Plate 484 remains coupled to casing 810 before, during, and after cartridge 380 is fired.

The mechanical coupling between plate 484 and casing 820 further seals the bore into which primer 810 is placed and the rear portion 480 to impede the passage of gas from inside casing 820 to the outside of casing 820 via the rear portion of casing 820. Ideally, the mechanical coupling between plate 484 and casing 820 forms a seal that stops a majority of gas, if not all, that originates inside of casing 820 from exiting via the rear portion of casing 820. The mechanical coupling between plate 484 and casing 820 further reduces, or eliminates nearly completely, the escape of residue from casing 820 via the rear portion of casing 820. Plate 484 reduces the residue that escapes from casing 820 during firing that may enter firing mechanism 130.

Plate 484 cooperates with firing pin 440 to activate primer 810. When struck by firing pin 440, plate 484 deforms. The force applied by firing pin 440 on plate 484 forms indentation 1010 on one side of plate 484. Preferably, firing pin 440 forms indentation 1010 without causing discontinuities (e.g., tears, holes, punctures, perforations) in the material of plate 484 as a discontinuity would permit gas to escape from casing 820 into firing assembly 130. On the other side of plate 484, the indentation forms a protrusion (not shown). The protrusion of indentation 1010 contacts primer 810, with a sufficient force of impact, to activate primer 810. The protrusion of indentation 1010 protrudes toward primer 810, which is forward, with respect to the direction of travel of a projectile launched by disrupter cannon 160, of plate 484.

In an implementation, plate 484 is 0.015 inches thick and formed of a soft aluminum. Plate 484 is coupled to casing 810 using an adhesive (e.g., super glue). The depth of the cavity in casing 810 that receives plate 484 is sufficiently deep so that the outer surface of plate 484 after it is glued in the cavity of casing 810 is about flush with the surface of rear portion 480 of casing 810. Because plate 484 is flush with a surface of the rear portion 480 of cartridge 380, the rear surface of cartridge 480 is substantially flat. Firing pin 440 forms an indentation in the soft aluminum of plate 484 to ignite primer 810 without destroying the structural integrity of plate 484. The protruding portion of indentation 1010 strikes primer 810 to ignite pyrotechnic 382.

Activating (e.g., actuate) primer 810 ignites pyrotechnic 382. Burning pyrotechnic 382 produces a rapidly expanding gas, heat, and by products (e.g., residue) from the chemical reaction of burning. The expanding gas removes (e.g., tears, burns, ejects) cover 486 to allow the expanding gas to enter bore 370 of barrel 110. The expanding gas increases the atmospheric pressure inside barrel 110.

Activating primer 810 may consume and/or weaken a portion of primer 810 so that the force of the expanding gas produced by pyrotechnic 382 may force primer 810 to decouple from casing 810. The force of the expanding gas may force primer 810 against plate 484. Preferably, as discussed above, plate 484 does not decouple from casing 810 when struck by primer 810. The expanding gas may further exit from casing 810 via primer 810. Preferably, plate 484 is not decoupled from casing 810 responsive to the force of the expanding gas that may bypass primer 810 or escape via the hole from which primer 810 was dislodged.

Plate 484 detains primer 810 so that primer 810, when decoupled by the force of the expanding gas, does not strike firing assembly 130 and/or firing pin 440.

When cartridge 380 is positioned in bore 370 of barrel 110, surface 482 contacts and end portion of barrel 110. Contact between surface 482 positions cartridge 380 in barrel 110. Contact between surface 482 and barrel 110 further establishes a seal that impedes a flow of gas from bore 370 of barrel 110 rearward toward firing assembly 130. When pyrotechnic 382 burns, the expanding gas presses against any projectile positioned forward of cartridge 380 and also moves between the surface of bore 370 and the outer surface of casing 820 toward rear portion 480 of cartridge 380. The seal formed by contact of surface 482 with a surface of barrel 110 impedes the flow of the expanding gas and limits, to some extent, the amount of gas that bypasses cartridge 380 to enter into firing assembly 130.

In an implementation, a forward portion of cartridge 380 has a diameter of about 0.76 inches. Rear portion 480 (e.g., rim) of cartridge 380 has a diameter of 0.88 inches. The forward portion of cartridge 380 may be positioned in bore 370 of barrel 110. Rear portion 480 of cartridge 380 will not enter bore 370 of barrel 110, but contacts and interferes with the breach end portion of barrel 110.

In the above implementation, the difference between the diameter of the forward portion of cartridge 380 and the diameter of rear portion 480 is 0.12 inches. Because forward portion of cartridge 380 is coaxial with rear portion 480, surface 482 is a band 0.06 inches wide around the front surface of rear portion 480. Accordingly, the 0.06 inch band is the amount of rear portion 480 that does not enter bore 370 of barrel 110. Further, the 0.06 inch band is the amount of surface of rear portion 480 that may contact the breach portion of barrel 110 to form a seal.

In an implementation, cartridge 380 has a length of about 2.85 inches and the thickness of end portion 480 (e.g., rim) is about 0.06 inches. So, all but 0.06 inches of cartridge 380 may be position in bore 370 of barrel 110.

In an implementation, casing 820, and thereby surface 482, are formed of aluminum. Barrel 110 is formed of titanium or stainless steel. Accordingly, the contact between surface 482 and the breech end portion of barrel 110 is contact between dissimilar metals.

A force applied by breech cap 120 on rear portion 480 of cartridge 380 may increase the efficacy of a seal formed between surface 482 and the surface of the breach end portion of barrel 110. The seal between surface 482 and barrel 110 may impede the movement of gas and/or residue around cartridge 380. Surface 482 may be coated (not shown) with a material to better seal against the movement of gas and/or residue.

Cartridge 380 further includes seal 340. In an implementation, seal 340 is an o-ring positioned around casing 820. Seal 340 is positioned in channel 830. Channel 830 retains seal 340 in a position during storage, transport, and use. Channel 830 positions seal 340 relative to casing 820. Channel 830 may further position seal 340 relative to barrel 110. For example, channel 830 is shown proximate to rear portion 480 in FIG. 8. In another implementation, channel may be positioned more forward on casing 820 thereby positioning seal 340 at a different position with respect to barrel 110 than the position shown in FIGS. 4 and 8.

Seal 340 contacts the outer surface of casing 820. When cartridge 380 is position in barrel 110, seal 340 contacts a surface of bore 370. Seal 340 may contact an end portion of barrel 110 to form a seal. Seal 340 may contact a surface of bore 370 forward of the end portion of barrel 110 to form a seal. Barrel 110 may include lip 472 positioned proximate to a rear portion of barrel 110. Lip 472 may have a diameter greater than the diameter of bore 370. Lip 472 may contact seal 340 to form a seal. Seal 340 may exert a resilient force on a surface of lip 472 to aid in removing expended cartridge 380 from barrel 110.

Lip 472 may reduce an area of contact between surface 482 and a surface of barrel 110.

Contact of seal 340 with casing 820 and the surface of bore 370 and/or lip 472 forms a seal that impedes the movement of the rapidly expanding gas toward end portion 480 of cartridge 380. Preferably, seal 340 impedes the movement of most, if not all, gas and/or residue beyond the location of seal 340. Seal 340 reduces the gas and/or residue that enters firing assembly 130.

Seal 340, surface 482, and plate 484 reduce the fouling of firing assembly 130 with contaminates (e.g., residue) carried by the expanding gas into firing assembly 130 thereby permitting multiple subsequent uses of disrupter cannon 160 without stopping use to clean firing assembly 130.

Instructors in the use of conventional disrupter cannons instruct the users to thread the breech cap on to the barrel completely then to unscrew the breech cap ¼ turn to increase the likelihood of being able to remove the breech cap after firing. Conventional use of disrupter cannons eliminates any sealing that may be formed by surface 482. Even if the cartridge used in a conventional disrupter cannon included plate 484, conventional use removes any support that the breech cap may provide to plate 484. Movement of the cartridge in the breech cavity due to the distance between the breech cap and the end portion of the barrel increases the force delivered to the breech cap during firing thereby increasing the likelihood of requiring tools to remove the breech cap. Movement of the cartridge also provides a path for the passage of gas and residue from the cartridge into the firing assembly.

According to various aspects of the present invention, firing assembly 130 also contributes to reducing the amount of maintenance (e.g., cleaning) that must be done to keep disrupter cannon 160 operational.

Firing assembly 130 includes housing 442, plug 432, retainer 434, magnet 436, cover 438, set screw 320, and firing pin 440. Housing includes threads 312 for coupling firing assembly 130 to breech cap 120, bore 430 for retaining the components of firing assembly 130 inside housing 442, and threads 310 for coupling to plug 432. Cover 140 covers a rear portion of firing assembly 130 to protect it from dirt and contaminants. Firing assembly 130 cooperates with shock tube 150 to fire disrupter cannon 160.

Firing assembly 130 and firing pin 440 perform the functions of a firing assembly and a firing pin respectively discussed above.

A housing retains the components of a firing assembly. A housing couples to a breech cap. A housing positions a firing pin relative to cartridge. A housing protects the components of a firing assembly from shock during firing (e.g., operation) of a disrupter cannon. A housing includes a cavity (e.g., bore) for receiving the components of a firing assembly. A housing includes an opening for receiving the components of the firing assembly into the cavity. The components of the firing assembly are inserted into the opening during assembly. The components are removed via the opening when removing the components of the firing assembly for cleaning. A housing includes an opening for exit of at least a portion of the firing pin to activate a primer of a cartridge. A firing pin may momentarily protrude from the opening. A firing pin may withdraw back into the housing.

A retainer positions components of the firing assembly in the cavity of the housing. A retainer retains components of the firing assembly in the cavity. A retainer includes a passage through the retainer. The passage allows a flow of gas through the passage to move the firing pin. A retainer may hold other components in place. A set screw may hold a retainer in place while in the housing. Positioning a retainer in a housing may form a chamber in a forward portion of the housing for holding a firing pin.

A firing pin moves responsive to a force. A firing pin may move responsive to a force controlled by a user of the disrupter cannon. A firing pin provides a force to activate a primer. As discussed above, a firing pin may move from a pre-firing position to a firing position. In a firing position, a firing pin activates a primer to ignite a pyrotechnic to launch a projectile. A firing pin may return from the firing position to the pre-firing position. A force may move a firing pin from a pre-firing position to a firing position. A different force may move the firing pin from the firing position to the pre-firing position.

A tip of a firing pin is of a suitable size and/or shape for activating a primer. According to various aspects of the present invention, a tip of a firing pin is of a suitable size, shape, and/or length to dent (e.g., make an indentation in) a plate sufficiently to activate a primer. A tip of a firing pin is of a suitable shape, size, and length to dent a plate without causing a discontinuity (e.g., perforation) in the plate.

A force may move a firing pin from a pre-firing position to a firing position. A force that moves a firing pin toward a primer may be of sufficient magnitude to move the firing pin with sufficient momentum (e.g., velocity, force) to activate the primer. A force may be of sufficient magnitude so that the firing pin creates an indentation on one side of a plate. The indentation results in a protrusion on another side of the plate. The protrusion activates a primer. A firing pin may include a surface for receiving a force to move the firing pin from a pre-firing position to a firing position.

A different force may move the firing pin from the firing position to the pre-firing position. The force that returns the firing pin to the pre-firing position may have a different source and/or be of a different type than the force that moves the firing pin from the pre-firing position to the firing position. For example, a force that moves the firing pin from a pre-firing position may include a force of an expanding gas whereas the force that returns the firing pin to the pre-firing position may include a spring force or a magnetic force.

The force that moves the firing pin from the firing position to the pre-firing position may be continuously exerted on the firing pin, but temporarily overcome by the force that moves the firing pin from the pre-firing position to the firing position. The magnitude of a force that acts on the firing pin to move the firing pin from the pre-firing position to the firing position may be constant or vary in accordance with the distance of the firing pin from the retainer. A magnitude of a force that acts on the firing pin to return the firing pin to the pre-firing position may vary in accordance with the distance of the firing pin from the retainer. The variation may be proportional. The magnitude of the force that acts on the firing pin to return the firing pin to the pre-firing position may vary inversely with the distance from the retainer. For example, the force exerted on a firing pin to return the firing pin to the pre-firing position may decrease as the firing pin moves forward toward the cartridge.

A magnet may provide a magnetic field. A magnetic field may exert a force on an objected that is attracted or repelled by a magnetic field. The force provided by the magnetic field of a magnet may be described herein as a force of the magnet.

An expanding gas from a shock tube may provide the force for moving the firing pin from the pre-firing position to the firing position. A magnet may provide a force for moving a firing pin from firing position to a pre-firing position. A force from a magnetic field of a magnet may continuously act on a firing pin to attract the firing pin toward the magnet and away from the cartridge. A magnitude of the force of the expanding gas from the shock tube may overcome the magnitude of the attractive force of the magnet to move firing pin away from the magnet toward the cartridge. The magnitude of the force on the firing pin provided by the expanding gas of the shock tube may be sufficiently greater than the attractive force of the magnet on the firing pin to move the firing pin forward with sufficient momentum to activate the primer.

The difference between the magnitude of the force of the expanding gas acting on the firing pin and the magnitude of the force of the magnet acting on the firing pin may be described as a net force. When the magnitude of the force of the expanding gas on the firing pin is greater than the magnitude of the force of the magnet on the firing pin, the net force is a forward net force that moves the firing pin toward the firing position. When the magnitude of the force of the expanding gas on the firing pin is less than the magnitude of the force of the magnet on the firing pin, the net force is a rearward net force that moves the firing pin toward the pre-firing position.

A magnet may be positioned forward of the retainer. A magnet may include a bore that permits passage of the expanding gas from the shock tube to the firing pin. A cap may couple a magnet to the retainer. A cap may protect a magnet from damage. A cap may include a bore that permits passage of the expanding gas from the shock tube to the firing pin.

A magnet may include a ferromagnetic magnet and/or a ferromagnetic magnet. A magnet may be formed of iron and alloys thereof. A magnet may include rare earth metals. A magnet may be formed of a lodestone. A magnet may provide a magnitude of a magnetic force in excess of 1 tesla.

A plug is positioned in the cavity of the housing behind, with respect to the firing pin, the retainer. A plug couples to the housing. A plug provides an addition force of coupling to retain the components of the firing assembly in the housing during operation of the disrupter cannon. A plug may position a shock tube relative to the components of a firing assembly. A plug may hold (e.g., retain) a shock tube for operation of the disrupter cannon. A plug may include a bore for receiving and holding a shock tube.

A cover may cover a rear-end portion of a housing, with or without the components of the firing assembly positioned in the housing. A cover reduces an amount of dirt and/or contaminates that enters firing assembly. A cover may further support a shock tube. A cover may include a bore for receiving a shock tube for coupling to the components of a firing assembly. A cover may remain coupled to a firing assembly during use of the disrupter cannon. A cover may couple to the housing of a firing assembly by friction fit.

Figure 4:
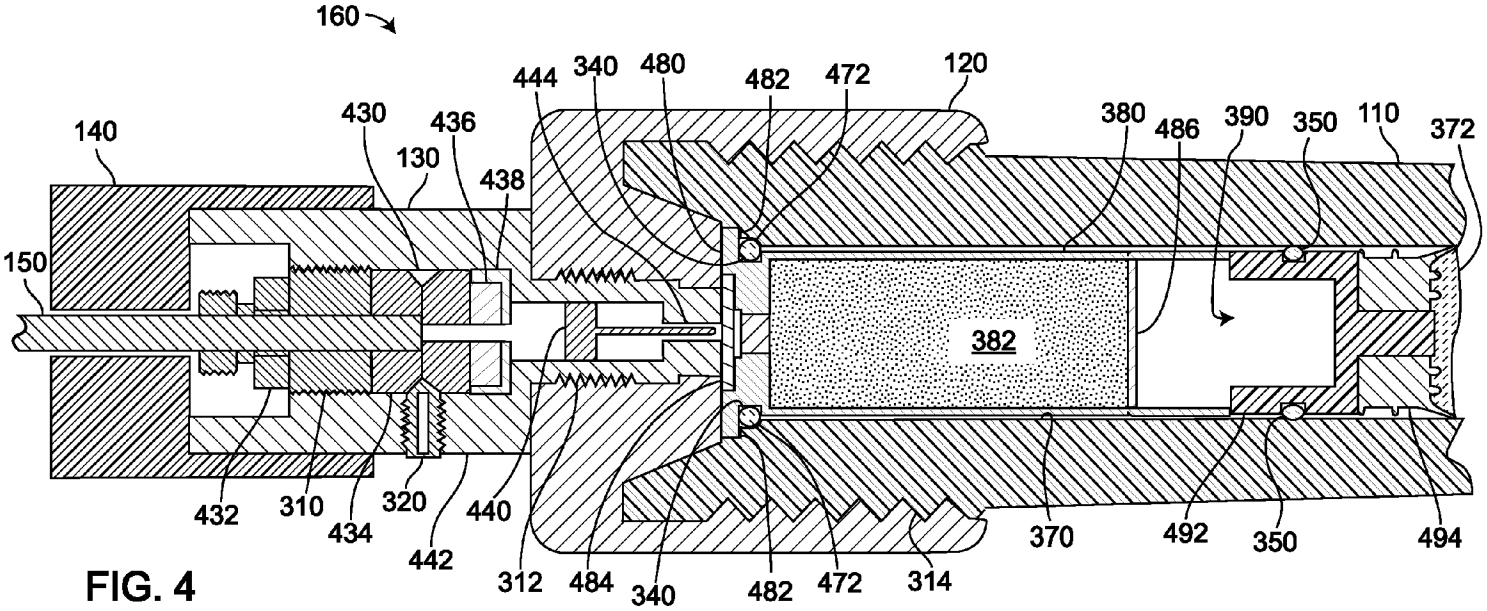
FIG. 4 is a close-up view of the cross-section view of FIG. 3 toward the breech end portion of the disrupter cannon.

In an implementation, housing 442 includes internal cavities (e.g., bores) of four different diameters. The smallest diameter cavity (e.g., bore) is positioned in the forward most portion of housing 442 and opens to the outside of housing 442. The largest diameter cavity is positioned in the rearward most portion of housing 442 and is open to the outside of housing 442. The cavities are referred to herein as the rear cavity, bore 430, the firing pin chamber, and the forward cavity. The rear cavity corresponds to the cavity having the largest diameters toward the rear of housing 442. Bore 430 is positioned forward of the rear cavity and is indicated in FIG. 4. The firing pin chamber is positioned forward of bore 430. The forward cavity is positioned forward of the firing pin chamber.

In an implementation, the cavities are coaxial bores of different diameters.

A portion of firing pin 440 moves along the forward cavity to exit an opening in housing 442 to activate a primer. A portion of firing pin 440 extends out of the opening and beyond a forward surface of housing 442 while firing pin 440 is positioned in firing position. The portion of firing pin 440 that extends from housing 442 moves inside housing 442 when firing pin 440 moves from the firing position to the pre-firing position.

Firing pin 440 is positioned in the firing pin chamber, either wholly or partially, while firing pin 440 is in the pre-firing position. A portion of firing pin 440 remains in the firing pin chamber during operation, but moves along the length thereof between the pre-firing and firing positions.

Cover 438 is positioned forward most in bore 430 and contacts an end portion of bore 430 proximate to the firing pin cavity. Cover 438 closes, except for the bore through cover 438, the rear end portion of the firing pin cavity to retain (e.g., trap) firing pin 440 in the firing pin chamber. Magnet 436 is positioned in bore 430 behind and in cover 438. Magnet 436 is positioned in bore 430 such that the pole of magnet 430 that attracts firing pin 440 is oriented toward firing pin 440. Retainer 434 is positioned in bore 430 behind magnet 436. Retainer 434 is held in place with respect to housing 442 by set screw 320. Set screw 320 threadedly couples to housing 442 such that an end portion of set screw 320 enters bore 430 to interfere with retainer 434. The interference between set screw 320 and retainer 434 holds (e.g., retains) retainer 434 in a set (e.g., fixed) position in bore 430. Retainer 434 in turn holds magnet 436 and cover 438 in position in bore 430.

Plug 432 couples to housing 442 in bore 430 rearward of retainer 434. Plug 432 threadedly couples to housing 442 using threads 310. Shock tube 150 is positioned in a bore in plug 432. Plug 432 retains shock tube 150 by friction. Shock tube 150 is further positioned in a bore that penetrates a portion of retainer 434.

As discussed above, shock tube 150 is a hollow tube. Shock tube 150 is open on the end portion that is inserted into plug 432 and retainer 434. The open end of shock tube 150 is in fluid communication with the bore through the remainder of retainer 434, magnet 436, cover 438, and the firing pin chamber. Any fluid (e.g., air, gas) that moves out of shock tube 150 passes through the bores of retainer 434, magnet 436, and cover 438 to enter the firing pin chamber.

Shock tube 150 is further positioned through a bore in cover 140 and cover 140 is coupled to a rear end portion of housing 442.

In operation, firing assembly 130 is assembled as discussed above and coupled to breech cap 120, which is coupled to barrel 110. Cover 140 is positioned around housing 442 and shock tube 150 inserted through cover 140 into plug 432 and into a portion of retainer 434. Cartridge 380 is positioned in barrel 110.

The magnetic force from magnet 436 moves firing pin rearward in the firing chamber, as shown in FIG. 11, thereby positioning firing pin 440 in the pre-firing position. Firing pin 440 is formed of a material (e.g., ferrous) that is attracted by a magnetic force. The other components of firing assembly 130 are preferably formed of a material (e.g., non-ferrous) that is not affected by a magnetic force (e.g., titanium, aluminum).

In an implementation, firing pin 440 is formed of a 17-4PH stainless steel alloy. Firing pin 440 is susceptible to a magnetic field and/or magnetized.

As discussed above, in the pre-firing position, firing pin 440 does not protrude from housing 442 as further shown in FIG. 11. Firing pin 440 remains in the pre-firing position until a force is applied to firing pin 440. A force may overcome the magnitude of the magnetic force of magnet 436. A force may move firing pin 440 away from the pre-firing position. A force may move firing pin 440 into the firing position as shown in FIG. 12. A force of sufficient magnitude may move firing pin 440 away from the pre-firing position and into the firing position with sufficient momentum to form an indentation in plate 484, activate primer 810, and activate cartridge 380.

Shock tube 150 provides a force for moving firing pin 440 from the pre-firing position to the firing position. As discussed above, igniting shock tube 150 causes an expanding gas to exit the end portion of shock tube 150. The expanding gas applies a force on firing pin 440. Firing pin 440 includes a rearward surface of a larger diameter for cooperating with the expanding gas to move firing pin 440. The force from shock tube 150 overcomes the force exerted by magnet 436 on firing pin 440 to move firing pin 440 away from the pre-firing position into the firing position. The expanding gas from shock tube 150 moves firing pin 440 with sufficient momentum (e.g., velocity, force) to indent plate 484, activate primer 810, and fire cartridge 380.

As the pyrotechnic in shock tube 150 is expended, the magnitude of the force of the expanding gas from shock tube 150 decreases. At a threshold, the magnitude of the force from magnet 436 overcomes the force of the expanding gas from shock tube 150 to move firing pin 440 back to the pre-firing position.

The gas from shock tube 150 deposits at least some residue, although likely not much, in the firing pin chamber, on cover 438, on firing pin 440, and along the walls of the firing pin chamber. Further, gas from cartridge 380 may enter bore 444 to deposit residue. Any gas from cartridge 380 that enters the firing pin chamber, especially the gas from cartridge 380, may carry substantial amounts of residue.

Residue in the firing pin chamber may interfere with movement of firing pin 440. Interference with firing pin 440 may preclude disrupter cannon 160 from operating properly. Firing assembly 130 may need to be removed from breech cap 120 and clean to restore proper operation. Frequent cleaning of firing assembly 130 decreases the utility and efficiency of disrupter cannon 160. Magnet 436 reduces the negative effect of residue on the operation of firing assembly 130.

Conventional disrupter cannons include a spring that applies a force that moves the firing pin from the firing position to the pre-firing position. A spring has several disadvantages. The operation of a spring is easily effected by residue (e.g., debris, burnt gun powder) from the expanding gas from the cartridge or the shock tube. Residue on the spring interferes with proper operation of the spring. Residue may affect the force provided by the spring to move the firing pin. A firing mechanism that includes a spring must be disassembled and cleaned frequently or the firing assembly ceases to function properly. Residue on magnet 436 does not interfere with the force provided by magnet 436.

Further, when a spring either pulls the firing pin back toward the pre-firing position or pushes the firing pin toward the pre-firing position (e.g., away from bore 444), the amount of force required to move the firing pin increases as the firing pin moves away from the pre-firing position and toward the firing position.

For example, a spring attached to the rear portion of the firing pin stretches as the firing pin moves away from the pre-firing position. As the spring stretches, the force the spring applies on the firing pin increases. If a spring is positioned between the firing pin and the forward portion of the firing pin chamber, as the firing pin moves toward the cartridge, the spring is compressed to return the firing pin to the pre-firing position. As the spring is compressed, the force applied by the spring on the firing pin increases.

If the magnitude of the force applied by shock tube 150 to move the firing pin is constant, the momentum of the firing pin may actually decrease as the firing pin moves away from the pre-firing position. A decrease in the magnitude of the firing pin as it moves from the pre-firing position to the firing position may decrease reliable firing of the disrupter cannon. The amount of force exerted by the spring may increase as the spring is coated with residue. Further, the displacement of the spring may decrease as it is coated with residue.

The magnitude of the force applied by magnet 436 on firing pin 440 decreases as firing pin 440 moves away from the pre-firing position. If the magnitude of the force applied to move firing pin 440 away from the pre-firing position is constant, the momentum of the firing pin may actually increase as firing pin 440 moves away from the pre-firing position. An increase in momentum as firing pin 440 moves from the pre-firing position to the firing position may increase the likelihood of consistently firing the cartridge.

Magnet 436 eliminates a spring for moving firing pin 440 from the firing position to the pre-firing position. The force applied by magnet 436 is less affected by residue. Magnet 436 more reliably moves firing pin 440 from the firing position to the pre-firing position. Residue is less of an impediment to movement of firing pin 440 when magnet 436 provides the return force as opposed to a spring.

As discussed above, a projectile launched by a disrupter cannon may include a liquid. According to various aspects of the present invention, a piston may increase the force provided by a liquid projectile thereby making liquid projectiles effective against a wider range of explosive devices.

Conventional disrupter cannons that expel (e.g., propel, launch) a liquid (e.g., water) projectile are effective against soft targets (e.g., backpacks, brief cases, fabric bags), but not hard targets (e.g., steel pipe bombs) because the force delivered by the liquid to the explosive device is not sufficient to disable and/or destroy hard targets.

Conventional disrupter cannons position a flexible vinyl plug (e.g., sheet, membrane) in front of a cartridge positioned in the barrel to slow the movement of water from in front of the cartridge to the cartridge or the firing assembly. The flexible vinyl plug slows the movement of water until the muzzle of the barrel is plugged (e.g., stopper 360) and the muzzle of the barrel is positioned downward toward the explosive device. Once the barrel is pointing toward the explosive device, the muzzle is positioned at a lower elevation than the breech and the cartridge, so the liquid cannot move toward the breech or the cartridge. When the cartridge is fired, the rapidly expanding gas from the pyrotechnic of the cartridge destroys the flexible vinyl plug prior to exit of all of the liquid from the barrel.

The propulsive force of cartridge may be harnessed (e.g., directed, focused) to impart (e.g., provide, transfer) an increase proportion of the total propulsive force to the liquid resulting in an increase amount of force (e.g., momentum) delivered by the liquid to an explosive device. Delivering a liquid at a greater force toward an explosive device enables a liquid projectile to disable and/or destroy a greater range of explosive devices while retaining the benefits (e.g., dispersal, dampening) of a liquid projectile.

A piston may include base 492, wad 494, and seal 350. Base 492 may include channel 550 and post 552. Wad 494 may include skirt 590 and nubs 496. Piston 390 performs the functions of a piston discussed above. Seal 350 performs the functions of a seal discussed above.

A piston may be positioned in a breech end portion of a barrel. A piston may be positioned forward of a cartridge (e.g., between cartridge and the muzzle). A piston may seal a breech end portion of a barrel. A piston may retain a liquid forward of a cartridge. A piston may retain a liquid in a bore of a barrel. A piston may seal a barrel so that a liquid does not move (e.g., leak, run) toward the breech end portion of the barrel prior to propelling the liquid from the barrel.

A cartridge may provide a propelling force directed toward a piston. A piston may receive the propelling force provided by a cartridge. Responsive to a propelling force, a piston may retain its shape and structural integrity. A piston may transfer a propulsive from a cartridge to a liquid positioned in the bore of the barrel forward of the piston. A propelling force may move the piston from the breech end portion of the barrel toward the muzzle end portion of the barrel. A propelling force may expel a piston from the barrel.

A piston may form a seal with a surface of the bore of the barrel as the piston moves through the barrel responsive to a propelling force. A piston may transfer a propulsive force from a cartridge to a liquid in the barrel while sealing the barrel. Because a piston applies (e.g., transfers) the propelling force to the liquid in the barrel while retaining its structural integrity and providing sealing, the piston transfers (e.g., imparts) a greater proportion of the propulsive force from the cartridge to the liquid than prior apparatus and methods used by conventional disrupter cannons to propel a liquid projectile. A piston may expel liquid from a barrel with a magnitude of force (e.g., momentum) that is greater than prior conventional disrupter cannons. A piston may increase an amount of force provided by a liquid projectile to an explosive device to enable the liquid projectile to disable and/or explode a hard target explosive device.

A piston may exit a barrel with the liquid projectile. A piston may be retrieved after launch. Because the structural integrity of a piston is not damaged by launching the liquid projectile, the piston may be reused for a subsequent launch of another liquid projectile.

A base may receive a propelling force from a cartridge. A base may transfer a propelling force from the cartridge to a liquid in the barrel. A base may retain its shape and/or structural integrity during application of a propelling force from a cartridge. A base may remain coaxially positioned in a barrel during application of a propelling force. A base may remain coaxially positioned in a barrel as the base moves from a breech end portion of the barrel along a length of the barrel to a muzzle end portion of the barrel. A base may provide a rigid structure for transferring a propelling force to a liquid in the barrel. A base may increase efficiency of transfer of a propelling force to a liquid in the barrel. A base may increase a momentum of a liquid expelled from a barrel.

A base may be formed of any material that substantially retains its shape and structural integrity during application of the propelling force. A base may be formed of any material that permits the base to move along a bore of the barrel during application of a propelling force. Suitable materials may include metals (e.g., titanium, steel, aluminum), plastics, and rubbers.

A seal may contact (e.g., touch) an inner surface of a bore of a barrel to form a seal with the barrel. A seal may inhibit passage of a liquid from the barrel toward the breech end portion of the barrel. A seal may retain a seal with an inner surface of the barrel during application of a propelling force. A seal may retain a seal with an surface of a bore of the barrel while the base moves along the barrel responsive to a propulsive force. A seal may inhibit movement of rapidly expanding gases from behind the base, with respect to the muzzle end portion of the barrel, to in front of the base. A seal may decrease an amount of expanding gas that bypasses (e.g., goes around) the base. A seal may hold (e.g., retain) a rapidly expanding gas behind (e.g., breech-ward of) a base. A seal may focus (e.g., direct, steer) a propelling force to act on a base. A seal may increase a proportion of a propelling force that acts on a base as opposed to bypassing the base. A seal may result in a greater amount of propelling force being applied to a base and subsequently to a liquid in the barrel forward of the base. A seal may decrease an amount of a propelling force that bypasses a base without propelling the base and thus the liquid in the barrel.

A seal is preferably used with a smooth bore barrel.

A seal may be formed of any material suitable for forming a seal with a surface of a bore of a barrel. A seal may be formed of any material suitable for retaining a seal with a surface of a bore of a barrel while the seal moves along a length of the bore of the barrel. A seal may be formed of a material suitable for sealing with a metal and/or composite material. Suitable materials may include rubbers, butyls, and plastics.

A wad may contact a surface of a bore of a barrel to form a seal with the barrel. A wad may perform the functions of a seal as discussed above. A wad may include a skirt. A skirt may be formed of a flexible material. A skirt may move outward (e.g., toward surface of bore) during application of a propelling force to the piston and/or movement of the wad along the barrel. Movement of a skirt outward may increase a sealing pressure applied by a wad on a surface of a bore of a barrel. A skirt may decrease an amount of an expanding gas that bypasses the piston without applying a propelling force on the base as discussed above. A shirt may decrease an amount of liquid that bypasses the piston toward the breech before and/or during launch.

A wad may apply a force against a liquid in a barrel. A wad may receive a force form a base. A wad may transfer a force from a base to a liquid. A wad may mechanically couple to a base.

A wad may be formed of a material suitable for sealing and for transferring a force. A material for a wad may include Teflon and plastics.

A post may position a wad with respect to a base and a barrel so the wad may perform the functions of a wad. A wad may include a bore for receiving the post. A post may retain a wad in a position to seal with a barrel. A post may position a wad to retain a seal with a surface of a bore of the barrel as the wad moves along the barrel. A post may retain a wad in a position for axial movement and/or sealing along a barrel. A wad may couple to a post. A wad may use any conventional coupling to couple to a post. A wad may couple to a post using a press fit. A wad may be decoupled and removed from a post and/or a base for replacement. A wad may remain coupled to a post for launch of a subsequent liquid projectile.

In one embodiment, a base and a wad are integrally formed.

For example, disrupter cannon 160 may be prepared for launching a liquid projectile by removing breech cap 120 from barrel 110 and inserting piston 390 into the breech end portion of bore 370 of barrel 110. A tool (not shown) may be used to insert and/or position piston 390 in bore 370. Piston 390 may be positioned forward of where cartridge 380 will be positioned. Cartridge 380 may then be inserted. A tool (not shown) may be used to insert and/or position cartridge 380 in bore 370 of barrel 110. Breech cap 120 is coupled to the breech end portion of barrel 110. Trigger assembly 130 is coupled to breech cap 120. Shock tube 150 is positioned through cover 140, plug 432, and a portion of retainer 434.

Barrel 110 is positioned with the muzzle end portion upward while bore 370 of barrel 110 is filled with liquid 372, which in this example is water. At least seal 350 of piston 390 restricts movement of liquid 372 from moving past seal 350 and base 492 toward cartridge 380. Skirt 590 and nubs 496 of wad 494 may provide additional sealing against movement of liquid 372 toward cartridge 380. Once barrel 110 is full of water, stopper 360 is inserted into the muzzle end portion of barrel 110 to seal the water in bore 370 of barrel 110. Stopper 360 may include a small bore 362 to permit the escape of a small amount of liquid 372 (e.g., amount displaced by stopper 360) so that stopper 360 may be inserted into barrel 110.

Once liquid 372 is in barrel 110 and stopper 360 is in place, mount 170 may be used to position (e.g., aim) disrupter cannon 160 toward the explosive device. An aiming device, such as a laser, may be additionally used to position disrupter cannon 160. In most cases, the explosive device is on the ground and disrupter cannon 160 is positioned with the muzzle end portion of barrel 110 toward the explosive device. Once positioned toward an explosive device, disrupter cannon 100 may be fired as discussed above.

When cartridge 380 is fired, as discussed above, the rapidly expanding gas from cartridge 380 applies a force on piston 390. As the force acts on (e.g., applied to) base 492 of piston 390, seal 350 retains its seal with the surface of bore 370 of barrel 110. The seal formed by seal 350 reduces the amount of liquid 372 that bypasses piston 390 to enter the breech end portion of barrel 110.

The propulsive force moves piston 390 toward the muzzle end portion of barrel 110. Movement of piston 390 moves liquid 372. As piston 390 moves, responsive to the propulsive force, base 492 retains its shape and structural integrity. As base 492 moves forward in barrel 110, base 492 applies a force on liquid 382 to move liquid 372 forward in barrel 110. Because base 492 retains its shape, base 492 transfers an increased percentage of the force provided by the expanding gas of cartridge 380 to liquid 372 as compared to the flexible membranes used in conventional disrupter cannons.

As piston 390 moves, seal 350 retains its seal with the surface of bore 370 of barrel 110. Skirt 590 of wad 494 flexes outward to apply increased pressure on the surface of bore 370 of barrel 110. The increased pressure of skirt 590 improves the seal between wad 494 and the surface of bore 370. The increased pressure applied by skirt 590 further decreases the amount of liquid 372 that bypasses piston 390. The increased sealing pressure of skirt 590 further acts to increase the efficiency of transfer of the propulsive force from cartridge 380 to piston 390 and from piston 390 to liquid 372.

As the expanding gas from cartridge 380 pushes on piston 390, piston 390 retains its shape and moves axially along barrel 110. Movement of piston 390 along barrel 110 transfers the propulsive force of the rapidly expanding gas to liquid 372. Piston 390 continues to apply a propelling force on liquid 372 in barrel 110 until piston 390 is ejected from the muzzle end portion of barrel 110. Piston 390 pushes liquid 372 along barrel 110, liquid 372 pushes stopper 360 out of the barrel, and liquid 372 exits barrel 110. Movement of piston 230 along a length of barrel 110 pushes liquid 372 out the muzzle end of barrel 110.

Because piston 390 does not deform, at least not very much, a greater portion of the energy of the expanding gas is transferred to liquid 372. Further, because seal 350, nubs 496 and skirt 590 retain a seal with surface of bore 370 of barrel 110 as piston 390 moves along barrel 110, the force of movement of piston 390 is more fully transferred to liquid 372 thereby resulting in increased momentum of liquid 372 as it exits barrel 110.

Piston 230 exits barrel 110 when it reaches the muzzle end of barrel 110.

Length 610 of base 492 permits base 492 to move axially along a length of barrel 110. Piston 390 does not tumble in barrel 110 as it moves along a length of barrel 110. Axial movement of piston 390 positioning seal 350, nubs 496, and skirt 590 to retain a seal with the surface of bore 370 of barrel 110. Length 620 of wad 494 may provide additional surface area to form a seal with the inner surface of barrel 110. Length 620 of wad 494 further improves axial movement of piston 230 along a length of barrel 110. Seal 234 is positioned in channel 330 to form a seal with base 232 and the inner surface of barrel 110. Post 320 positions and retains wad 236 in position with respect to base 232 and barrel 110.

Diameter 510 of seal 350 of base 492 is suitable for forming a seal with a surface of bore 370 of barrel 110 while stationary and/or moving. Diameter 510 of base 492 is suitable for permitting movement of base 492, and thereby piston 390, along a length of and out barrel 110. Diameter 520 of base 492 is further suitable for sealing with seal 350 and enabling axial movement of base 492 along a length of barrel 110.

Figure 5:
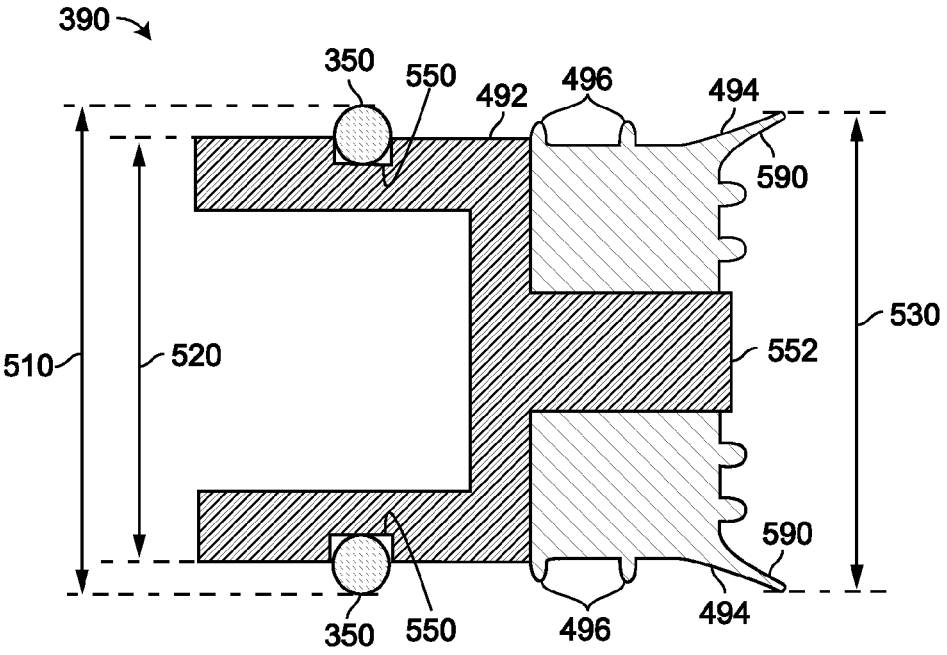
FIG. 5 is an enlarged cross-section view of the piston of FIG. 3.
Figure 6:
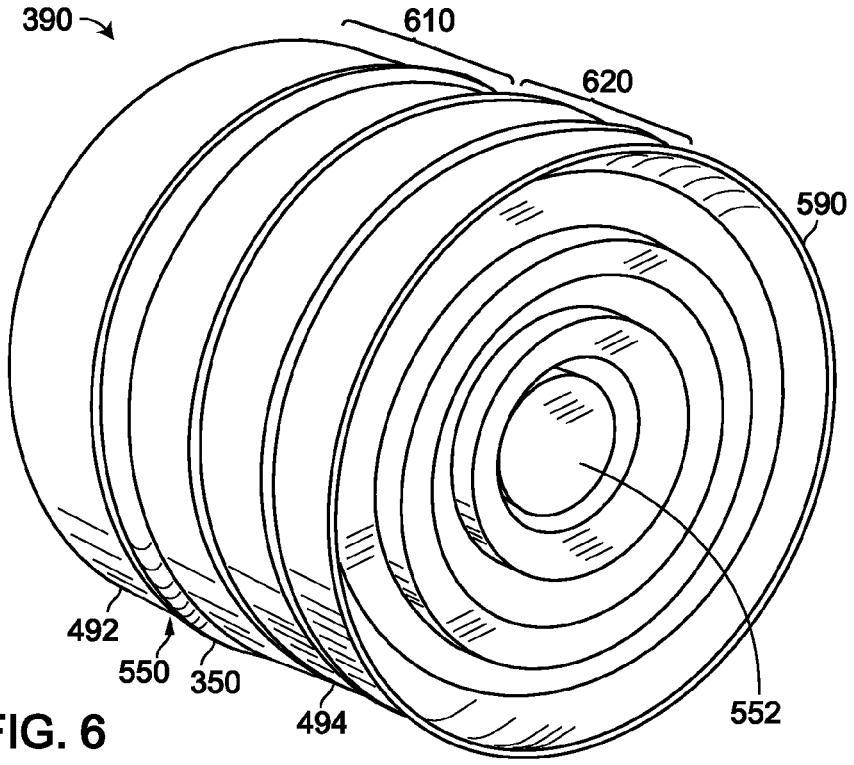
FIG. 6 is a perspective view of the piston of FIG. 3 showing the front and left side.
Figure 7:
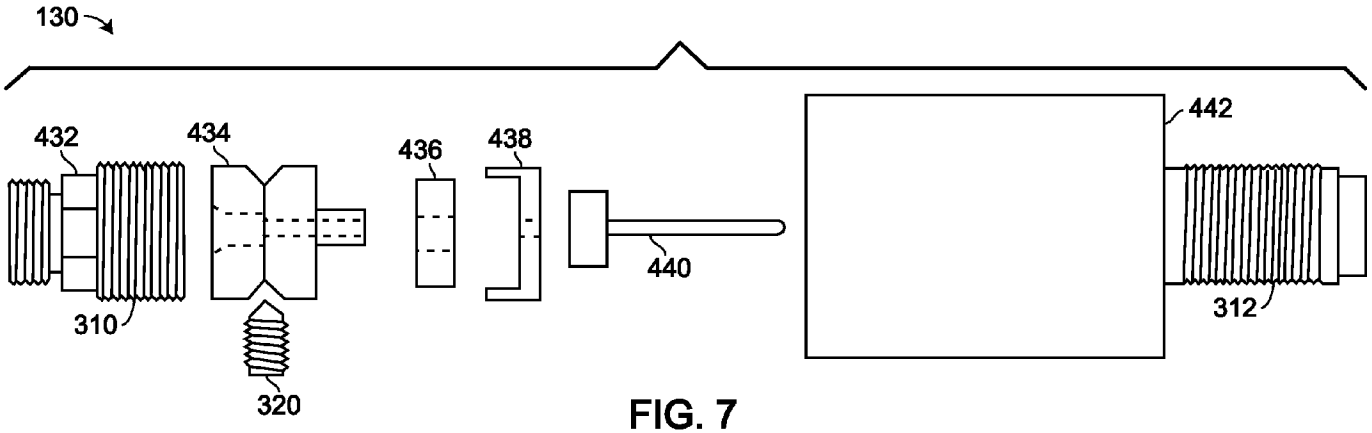
FIG. 7 is an exploded view of the firing assembly of FIG. 3.
Figure 8:
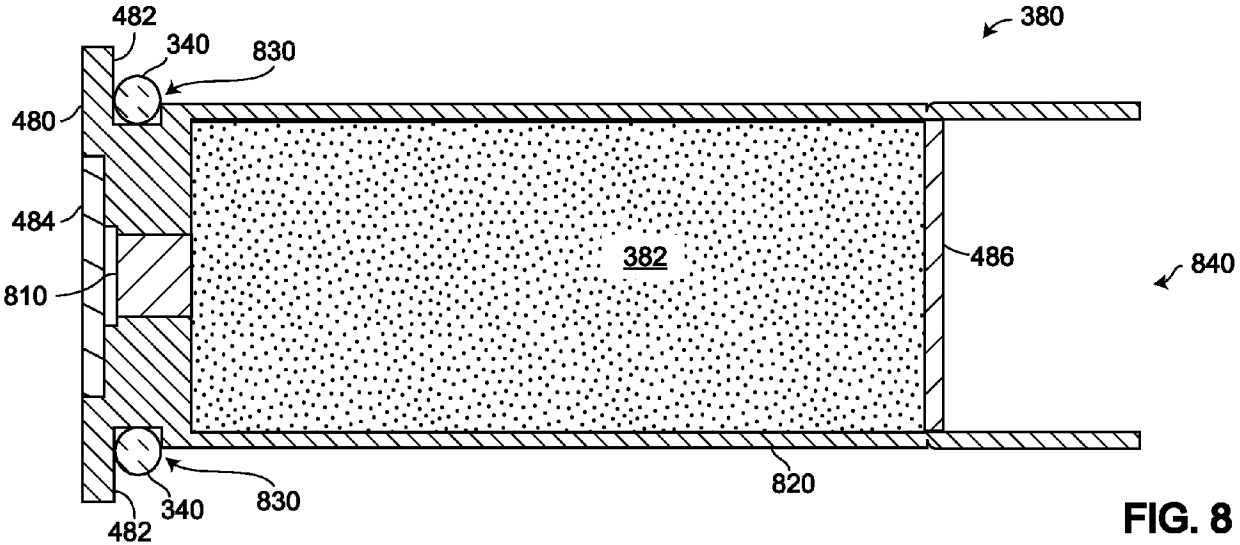
FIG. 8 is close-up view of the cross-section view of the cartridge of FIG. 3.
Figure 9:
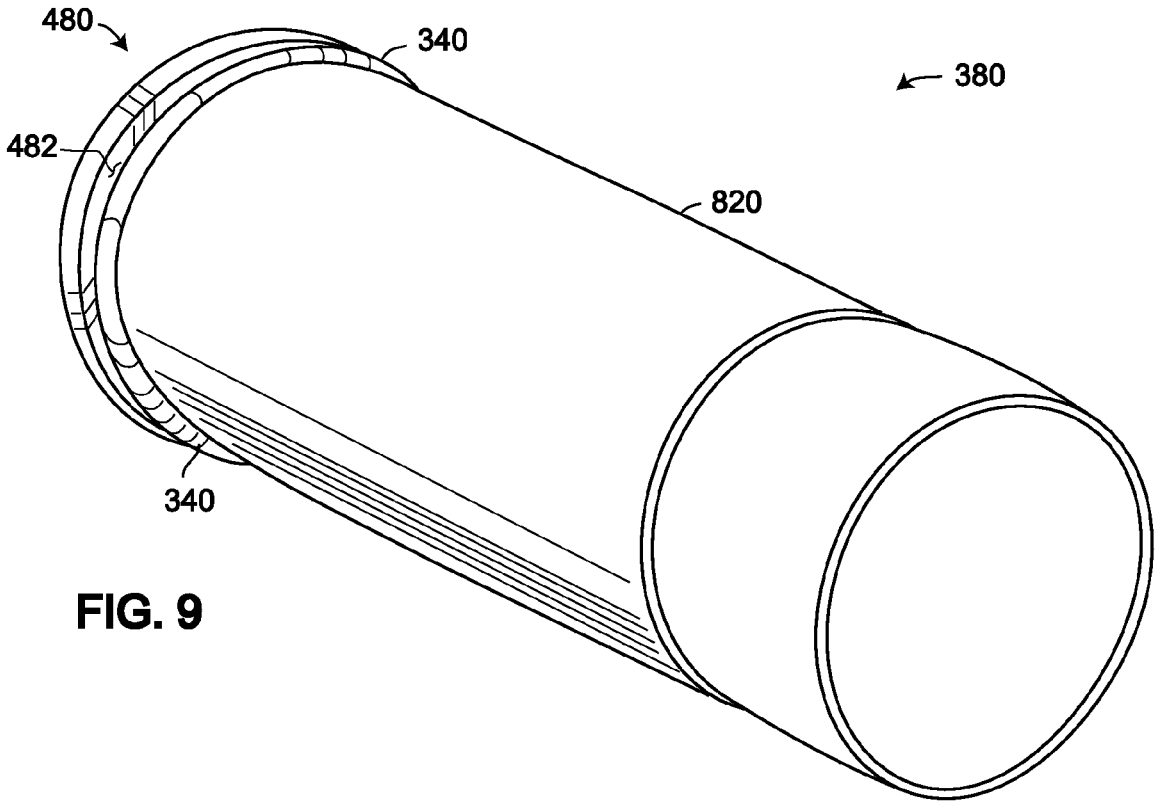
FIG. 9 is a perspective view of the cartridge of FIG. 3 showing the front and left side.
Figure 10:
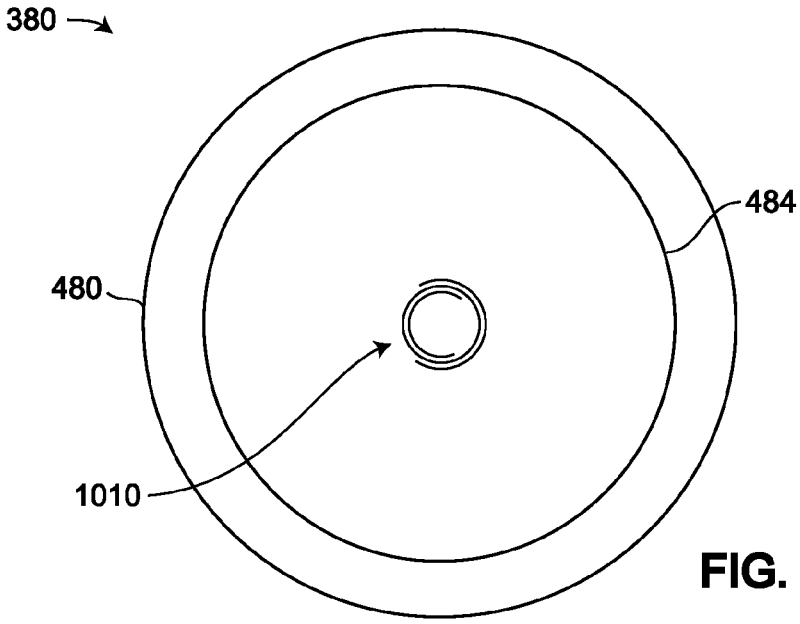
FIG. 10 is an end view of the cartridge of FIG. 3 showing the rear end portion of the cartridge after firing the disrupter cannon.

Base 492 may include channel 550 for positioning seal 350 on base 492. The shape of channel 550 may be rectangular, as shown in FIG. 5, or more circular to conform to the shape of seal 350 as shown in FIG. 5. Seal 350 may include a conventional o-ring. Seal 350 may be formed of rubber, butyl, and/or plastic.

Diameter 530 of wad 494 is suitable for forming a seal with surface of bore 370 of barrel 110 while stationary and/or moving. A height of nubs 496 may extend away from wad 494 and extend to diameter 530 or diameter 510. Nubs 496 may form additional seals with the surface of bore 370 while piston 390 is stationary and/or moving.

An outer surface of base 492 and/or wad 494 may be coated with a lubricant to facilitate movement of piston 390 along bore 370 of barrel 110. A lubricant may further facilitate forming a seal between seal 350, nubs 496, and/or skirt 59 and the surface of bore 370 of barrel 110. A lubricant may include silicone grease. A lubricant may be applied to any seal and/or sealing surface discussed herein.

A disrupter canon may be used to launch a variety of types of projectiles, in addition to a liquid projectile. A projectile of a particular type may be suitable for disabling and/or destroying a particular type of explosive device. As discussed above, a cartridge may include an amount (e.g., load) of pyrotechnic. A load may be suitable for launching a type of projectile. The muzzle velocity of a projectile launched from a disrupter cannon may be proportional to the load of the cartridge that launches the projectile. The efficacy of a disrupter cannon may be increased by launching a suitable projectile using a suitable load for the explosive device.

For example, types of projectiles may include projectiles 1300-1700 of FIGS. 13-17. Pyrotechnic 382 loads for cartridge 380 may include an extremely low load (e.g., 60 grains), a low load (e.g., 120 grains), a medium load (e.g., 140 grains), and a high load (e.g., 160 grains).

A projectile may include a base, a body, a nose, and seals. Cartridge 380 may include cavity 840 for receiving at least a portion of a base of a projectile. For example, projectiles 1300-1700 include base 1310-1710, body 1320-1720, nose 1330-1730, and seals 1340-1740 respectively.

A base may couple to a cartridge. A base may be inserted into a cavity of a cartridge. A diameter of a base may be suitable for insertion into a cavity of a cartridge. A diameter of a base may be suitable for inserting into and traversing a bore of a barrel. A base may receive a propelling force of a rapidly expanding gas from a cartridge. A base may include a surface for receiving a propelling force from a cartridge. A propelling force may decouple a base from a cartridge. A propelling force may push a base out of a cavity of a cartridge. A propelling force may move a base along a bore of a barrel. A propelling force may eject a base from the muzzle end portion of a barrel.

A diameter of a base may be less than a diameter of a body and/or a nose. A decreased diameter of a base may facilitate inserting the base into a cavity of a cartridge.

A body may mechanically couple to a base using any conventional coupling. Movement of a base may result in movement of a body. A body may remain coupled to a base during movement of the base and body along a bore of a barrel. A body may be solid. A body may include a cavity. A cavity of a body may carry a payload.

A payload may include one or more objects formed of a material that is different from the material of the body. A payload of a body may be released upon impact of the projectile with an explosive device. A payload may impact an explosive device. A size, shape, and/or material of a payload may be suitable for disabling and/or destroying a particular type of explosive device. A payload may include a laser device.

A nose may mechanically couple to a body of a projectile. A nose may be integral with a body of a projectile. Movement of a body may result in movement of a nose. A nose may traverse a bore of a barrel. A nose may exit a bore of a barrel. A nose may include an opening to a cavity in the body. An opening in a nose may permit the light of a laser to exit the body.

During flight of a projectile toward a target, a nose is positioned forward of a body and a base with respect to a direction of travel toward the target. Preferably, a nose strikes an explosive device before a base and/or a body of the projectile. A shape of a nose may be suitable for structurally damaging a particular type of exclusive device. A nose may strike an explosive device. A nose may penetrate an explosive device. A nose may disintegrate upon impact with an explosive device thereby releasing a payload. A nose may penetrate an explosive device prior to disintegrating to release a payload. A nose may penetrate a barrier positioned between the disrupter cannon and an explosive device, so that the projectile may strike the explosive device.

A seal mechanically couples to a projectile. A seal may encircle a base and/or body of a projectile to couple to the base and/or body of the projectile. A seal may mechanically couple a base to a cartridge. A seal may contact a surface of a cavity of a projectile to couple the projectile to the cartridge. A seal may contact a surface of a bore of a barrel as a projectile moves along a length of the barrel. A seal may position a projectile with respect to a surface of a bore of a barrel.

A seal may facilitate movement of a projectile a long a length of a barrel. A seal may include a lubrication. A lubrication may further facilitate movement of a projectile along a length of a barrel. A lubricate for a seal may include a silicone lubricant. A lubricant may be applied to a seal by a user of a disrupter cannon. A lubricate may be applied to a seal of a projectile prior to inserting the projectile into a bore of a barrel. A seal may include a conventional o-ring. A conventional o-ring may include an o-ring formed of plastic and butyl.

A projectile may be selected in accordance with a characteristic of an explosive device. A load of a projectile may be selected in accordance with a characteristic of the explosive device and/or the type of projectile. A cartridge may be loaded prior to use with a particular load. Selection of a load may include selection of a pre-manufactured cartridge.

A projectile may be coupled to a cartridge. A projectile may be coupled to a cartridge prior to insertion of the projectile and cartridge into a bore of a barrel. A projectile may be manually coupled to a cartridge by a user of a disrupter cannon. A projectile may be coupled to a cartridge without the use of tools. While positioned in a bore of a barrel prior to operating the disrupter cannon, the projectile is positioned forward of the cartridge. Because the projectiles of FIGS. 13-17 are not liquid projectiles, no piston is inserted into the bore of the barrel when using projectile 1200-1700.

For example, projectile 1300 includes base 1310, body 1320, nose 1330, and seals 1340. Base 1310 is suitable for inserting into cavity 840 of cartridge 380 to couple projectile 1300 to cartridge 380. Coupling base 1310 to cartridge 380 does not require tools.

Body 1320 includes at least one cavity. The one or more cavities of body 1320 include a laser device. The laser provides beam 1350 of light. Beam 1350 exits a bore in nose 1330. Beam 1350 is axial to a central axis of projectile 1300. Beam 1350 indicates a trajectory of projectile 1300 for at least a short distance after projectile 1300 exits the muzzle end portion of a barrel of a disrupter cannon. Projectile 1300 is suitable for situations that require precise deliver of the projectile to an explosive device. A shape of nose 1330 makes projectile 1300 suitable for penetrating steel or for cutting a hole in steel.

Projectile 1300 is suitable for use with a cartridge that has a high load. A high load cartridge provides sufficient force for propelling projectile 1300.

Projectile 1300 may include the laser projectile disclosed in U.S. Pat. No. 7,947,937 ("'937") issued on May 24, 2011 to Langner. The '937 patent is incorporated by references for any purpose.

Projectile 1400 includes base 1410, body 1420, nose 1430, and seals 1440. Base 1410 is suitable for inserting into cavity 840 of cartridge 380 to couple projectile 1400 to cartridge 380. Coupling base 1410 to cartridge 380 does not require tools. Body 1420 and nose 1430 are solid. A shape of nose 1430 makes projectile 1400 suitable for penetrating steel or for cutting a hole in steel. Projectile 1400 is suitable for use with a cartridge that has a medium or high load. Testing has shown that projectile 1400 launched with a high load cartridge will penetrate up to 3 quarter-inch plates that are spaced apart 2 inches. A maximum range of accurate travel of projectile 1400 is about 3 feet.

Projectile 1500 includes base 1510, body 1520, nose 1530, and seals 1540. Base 1510 is suitable for inserting into cavity 840 of cartridge 380 to couple projectile 1500 to cartridge 380. Coupling base 1510 to cartridge 380 does not require tools. Body 1520 and nose 1530 are solid. A shape of nose 1530 makes projectile 1500 suitable for penetrating steel. Projectile 1500 is suitable for use with a cartridge that has a medium or high load. Testing has shown that projectile 1500 launched with a high load cartridge will penetrate up to a one-half inch steel plate. A maximum range of accurate travel of projectile 1500 is about 3 feet.

Projectile 1600 includes base 1610, body 1620, and nose 1630. Base 1610 is suitable for inserting into cavity 840 of cartridge 380 to couple projectile 1600 to cartridge 380. Coupling base 1610 to cartridge 380 does not require tools. Body 1620 is formed of polyethylene. Body 1620 include a cavity. The cavity is filled with shot. A diameter of each sphere of shot may be in the range of 0.11 inches (e.g., #6 shot) to 0.12 inches (e.g., #5 shot) or larger. Nose 1630 is formed of polyethylene. Nose 1630 couples to body 1620. Nose 1630 may penetrate several inches into a target before the shot stored in the cavity of the body is released.

Nose 1630 makes projectile suitable for penetrating wood. The payload (e.g., shot) of projectile 1600 is suitable for disabling and/or destroying a target without exiting or continuing travel very far beyond the target. Testing has shown that projectile 1600 penetrates up to 6 inches of wood. A maximum range of accurate travel of projectile 1600 is about 3 feet. Projectile 1600 has been used to disable door locks. The door lock is removed or disabled and the shot does not continue very far beyond the door.

Projectile 1700 includes base 1710, body 1720, and nose 1730. Base 1710 is suitable for inserting into cavity 840 of cartridge 380 to couple projectile 1700 to cartridge 380. Coupling base 1710 to cartridge 380 does not require tools. Body 1720 is formed of plastic (e.g., delrin, pvc). Body 1720 include a cavity. The cavity of body 1720 may be filled with clay and/or shot. A diameter of each sphere of shot may be about 0.094 inches (e.g., #7-#7.5 shot). Nose 1730 is formed of cardboard. Nose 1730 couples to body 1620.

Body 1720 and nose 1730 makes projectile suitable for disabling and/or destroying pipe bombs. On impact, nose 1730 and body 1720 break to release the payload. The material of the payload conforms to the shape of the target, which is effective in knocking off the cap of a pipe bomb and venting the explosive substance inside the pipe.

Figure 18:
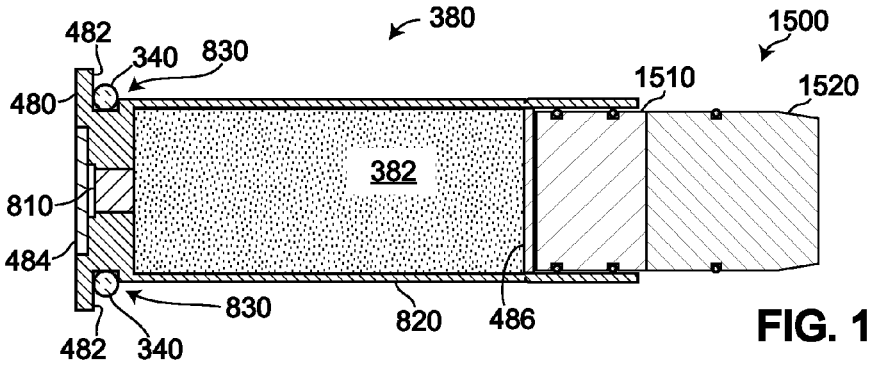
FIG. 18 is a cross-section view of the projectile of FIG. 15 inserted into the cartridge of FIG. 8.

Any one of projectiles 1300-1700 may be coupled to cartridge 380 by inserting base 1310-1710 respectively into cavity 840 of cartridge 380 and pressing the projectile and cartridge 380 together. Interference between base 1310-1710 and/or seals 1340-1740 couples projectile 1300-1700 to cartridge 380. Projectile 1300-1700 may be inserted into cavity 840 until it projectile 1300-1700 contacts a tapered surface of cavity 840 and/or cover 486. Projectile 1500 is shown coupled to cartridge 380 in FIG. 18.

The foregoing description discusses preferred embodiments of the present invention, which may be changed or modified without departing from the scope of the present invention as defined in the claims. Examples listed in parentheses may be used in the alternative or in any practical combination. As used in the specification and claims, the words 'comprising', 'including', and 'having' introduce an open ended statement of component structures and/or functions. In the specification and claims, the words 'a' and 'an' are used as indefinite articles meaning 'one or more'. While for the sake of clarity of description, several specific embodiments of the invention have been described, the scope of the invention is intended to be measured by the claims as set forth below.

What is claimed is:

1. An ammunition for disabling a provided explosive device, the ammunition for use with a provided disrupter cannon, the disrupter cannon includes a barrel, the ammunition comprising:

a projectile comprising a base portion, a body portion, and a nose portion, the projectile for striking the explosive device to disable the explosive device; and a cartridge comprising a pyrotechnic and a cavity, the cartridge for propelling the projectile in a forward direction toward the explosive device to disable the explosive device, the cavity positioned in a forward end portion of the cartridge, the cavity comprising an opening; wherein:

at least one of the body portion and the nose portion lacks a passage for transmitting light from or through the projectile forward of the projectile;

prior to use of the projectile and cartridge in the disrupter cannon, the projectile is separate from the cartridge;

the base portion is adapted for manual insertion without tools by an operator of the disrupter into the cavity via the opening to couple the projectile directly to the cartridge, manual insertion to be performed at the location of the explosive device; and the pyrotechnic provides a rapidly expanding gas that propels the projectile out of the cavity and out of the barrel of the disrupter cannon toward the explosive device.

2. The ammunition of claim 1 wherein the projectile is selected by the human operator of the disrupter cannon in accordance with a type of the explosive device.

3. The ammunition of claim 2 wherein the cartridge is selected by the human operator of the disrupter cannon in accordance with at least one of the selected projectile and the type of explosive device.

4. The ammunition of claim 1 wherein a material that forms at least one of the body portion and the nose portion is solid thereby prohibiting the transmission of light through the projectile.

5. The ammunition of claim 1 wherein an amount of pyrotechnic comprises one of a high load, a medium load, a low load, and an extremely low load.

6. The ammunition of claim 1 wherein an interference between the base and an inner surface of the cavity mechanically couples the projectile to the cartridge.

7. The ammunition of claim 1 wherein at least one of the base, the body, and the nose is formed of at least one of polyethylene, clay, and metal.

8. An ammunition for disabling a provided explosive device, the ammunition for use with a provided disrupter cannon, the disrupter cannon includes a barrel, the ammunition comprising:

a projectile comprising a base portion and a body portion, the projectile for striking the explosive device to disable the explosive device; and a cartridge comprising a pyrotechnic and a first cavity, the cartridge for propelling the projectile in a forward direction toward the explosive device to disable the explosive device, the first cavity positioned in a forward end portion of the cartridge, the first cavity comprising an opening; wherein:

the body portion includes a second cavity therein, the second cavity is filled with shot, the shot is arranged in the second cavity so that light cannot travel a straight path between the shot so that light cannot transmit from or through the body forward of the projectile;

prior to use of the projectile and cartridge in the disrupter cannon, the projectile is separate from the cartridge;

the base portion is adapted for manual insertion without tools by an operator of the disrupter into the first cavity via the opening to couple the projectile to the cartridge, manual insertion to be performed at the location of the explosive device;

the pyrotechnic provides a rapidly expanding gas that propels the projectile out of the first cavity and out of the barrel of the disrupter cannon toward the explosive device.

9. The ammunition of claim 8 wherein:

the projectile further comprises a nose; and the nose lacks a passage for transmitting light through the nose.

10. The ammunition of claim 8 wherein:

the projectile further comprising a nose portion; and the nose portion is for penetrating the explosive device before the shot is released from the second cavity.

11. The ammunition of claim 10 wherein a material that forms the nose portion is solid thereby prohibiting the transmission of light through the projectile.

12. The ammunition of claim 10 wherein the base, the body, and the nose is formed of polyethylene.

13. The ammunition of claim 8 wherein the cartridge is selected by the operator of the disrupter cannon in accordance with at least one of the selected projectile and the type of explosive device.

14. The ammunition of claim 8 wherein an amount of pyrotechnic comprises one of a high load, a medium load, a low load, and an extremely low load.

15. An ammunition for disabling a provided explosive device, the ammunition for use with a provided disrupter cannon, the disrupter cannon includes a barrel, the ammunition comprising:

a projectile comprising a base portion, a body portion, and a nose portion, the projectile for striking the explosive device to disable the explosive device; and a cartridge comprising a pyrotechnic and a cavity, the cartridge for propelling the projectile in a forward direction toward the explosive device to disable the explosive device, the cavity positioned in a forward end portion of the cartridge, the cavity comprising an opening; wherein:

at least one of the body portion and the nose portion lacks a passage for transmitting light from or through the projectile forward of the projectile;

the base portion is coupled directly to the cartridge by manual insertion of the base portion into the cavity via the opening, the base portion is coupled to the cartridge by an operator of the disrupter at a location of the explosive device;

the coupled projectile and cartridge is adapted for insertion into the disrupter cannon; and the pyrotechnic provides a rapidly expanding gas that propels the projectile out of the cavity and out of the barrel of the disrupter cannon toward the explosive device.

16. The ammunition of claim 15 wherein a material that forms at least one of the body portion and the nose portion is solid thereby prohibiting the transmission of light through the projectile.

17. The ammunition of claim 15 wherein the cartridge is selected by the operator of the disrupter cannon in accordance with at least one of the selected projectile and the type of explosive device.

18. The ammunition of claim 15 wherein an amount of pyrotechnic comprises one of a high load, a medium load, a low load, and an extremely low load.

19. The ammunition of claim 15 wherein at least one of the base, the body, and the nose is formed of at least one of polyethylene, clay, and metal.

* * * * *